US008297879B1

(12) United States Patent
Schmidt

(10) Patent No.: US 8,297,879 B1
(45) Date of Patent: Oct. 30, 2012

(54) ADJUSTABLE METHOD AND APPARATUS FOR LAYING, LEVELING AND COMPACTING ROAD SHOULDERS

(75) Inventor: Michael A Schmidt, Hartford, WI (US)

(73) Assignee: Miksue Enterpriz, LLC, Hartford, WI (US)

( * ) Notice: Subject to any disclaimer, the term of this patent is extended or adjusted under 35 U.S.C. 154(b) by 115 days.

(21) Appl. No.: 13/073,875

(22) Filed: Mar. 28, 2011

(51) Int. Cl.
*E04G 21/10* (2006.01)

(52) U.S. Cl. ..... 404/98; 404/104; 37/105; 172/811

(58) Field of Classification Search ..... 37/407, 37/381, 105; 404/96, 98, 104; 172/811
See application file for complete search history.

(56) References Cited

U.S. PATENT DOCUMENTS

| | | | | | |
|---|---|---|---|---|---|
| 1,987,729 | A * | 1/1935 | Bash | ..... | 172/784 |
| 2,116,612 | A | 5/1938 | Arndt | | |
| 2,188,553 | A | 1/1940 | Lathrop | | |
| 4,571,119 | A | 2/1986 | Jones et al. | | |
| 4,579,178 | A * | 4/1986 | Dover | ..... | 172/297 |
| 4,655,297 | A | 4/1987 | Bourgeois, Jr. | | |
| 4,790,715 | A | 12/1988 | Alexander | | |
| 4,900,185 | A | 2/1990 | Foertsch | | |
| 4,953,625 | A * | 9/1990 | Hurworth | ..... | 172/305 |
| 5,488,788 | A * | 2/1996 | Durbin | ..... | 37/443 |
| 6,089,785 | A | 7/2000 | Bergman | | |
| 6,612,774 | B1 | 9/2003 | Dulin | | |
| 7,510,348 | B2 * | 3/2009 | James | ..... | 404/96 |
| 7,540,687 | B2 | 6/2009 | Neumann | | |
| 7,624,520 | B2 * | 12/2009 | Gordon | ..... | 37/105 |
| 7,650,708 | B2 * | 1/2010 | Gordon et al. | ..... | 37/105 |
| 7,789,587 | B2 | 9/2010 | James | | |
| 8,205,359 | B2 * | 6/2012 | Gordon | ..... | 37/105 |
| 2006/0230646 | A1 * | 10/2006 | Schmidt et al. | ..... | 37/381 |
| 2007/0033840 | A1 * | 2/2007 | Schmidt | ..... | 37/383 |
| 2011/0016756 | A1 * | 1/2011 | Schmidt | ..... | 37/403 |
| 2011/0116865 | A1 * | 5/2011 | Schmidt | ..... | 404/72 |

* cited by examiner

*Primary Examiner* — Gary S Hartmann
(74) *Attorney, Agent, or Firm* — Brannen Law Office, LLC

(57) ABSTRACT

An apparatus for attachment to dump trucks having a dump bed and a chute for discharging material onto a road shoulder and/or roadway. The apparatus allows the truck with a single operator to perform shoulder and/or roadway surfacing and/or repair by receiving and grading repair material into place. The attachment being adjustable as to pitch, width and depth of the repair material. The attachment being adjustable to allow a greater or lesser amount of material to be applied to a shoulder closer to the roadway surface if a deeper fill is required. The apparatus allows for rotational movement between the apparatus and the dump truck in a direction parallel to the roadways length and perpendicular to the roadways surface. The tires of the dump truck being utilized to compact the repair material. The apparatus being stored in a vertical position when not in use.

17 Claims, 23 Drawing Sheets

ADJUSTABLE METHOD AND APPARATUS FOR LAYING, LEVELING AND COMPACTING ROAD SHOULDERS

FIELD OF THE INVENTION

The present invention pertains to an apparatus and method for laying, leveling and compacting road aggregate material and, more particularly, for providing an apparatus and method for adjusting the height, width and pitch of the shoulder as well as accommodating the pivotal movement of the yaw, or rotational movement, between the truck and apparatus perpendicular to the length of the road and for the vertical rotation of the truck and apparatus parallel to the length of the road.

BACKGROUND OF THE INVENTION

Most paved or concrete roadways in the U.S. are provided with shoulder regions consisting of granular aggregates such as gravel, sand, crushed rock, pebbles, crushed shells, crumbled waste rubber and other such materials or mixtures of materials as are readily available in local areas. After new roads are laid, or old roads refurbished, the road shoulders are laid down and compacted. Most often, this is accomplished using a dump truck to lay the aggregate in a strip next to the road. Then a grader is utilized to spread the aggregate evenly along the side of the road and slightly above the road surface. A compactor is then driven over the aggregate to compact the aggregate level with the road surface at one edge and pitching down and away from the road at the outside edge. The pitching of the aggregate away from the road surface allows for any rain, snow and other debris to flow away from the road surface for vehicle safety reasons. Finally, any aggregate remaining on the road is swept off the road and onto the shoulder.

Over the course of time, existing shoulders are subject to wind, rain, snow plowing, drivers driving on the shoulder and other conditions that cause the shoulders to deteriorate such that the shoulder needs to be repaired. The responsibility for road and shoulder maintenance and repair varies by area. Typically, a city, township or village is responsible for certain roadway areas within their boundaries while the counties and state are responsible for the other roadways and shoulders within the counties and states. The cost for purchasing graders and compactors can run into many hundred of thousands of dollars. For those counties and states that have a larger tax base to draw from, and where those areas have a greater amount of roadways to maintain, that cost may be justified. However, for most cities, townships and villages, those equipment purchasing costs cannot be justified as they only lay down and/or repair three (3) to five (5) miles of shoulder per year. The result is a wide range of alternatives for laying and/or maintaining road shoulders. Some smaller communities contract out the shoulder maintenance work to local contractors on a bidding process. Other villages and townships contract the work out to the county. Not including the cost of the aggregate, which costs between $4.25 and $5.25 per ton of material, the contracted costs, per mile of shoulder, varied between $3200.00 and $6383.00 in a local survey of nearby villages and townships. This amounts to between $9600.00 and $31,915.00 per year in taxpayer expense, depending upon the miles and bidding results. Others areas use their own dump trucks and a crew of employees to hand shovel and level the shoulders. Still others use their own snow plow trucks and snow plow blades to lay and level the shoulders. Neither of which are cost effective or easy to accomplish.

There have been other attempts at road shoulder working apparatus'. U.S. Pat. No. 7,789,587 to James discloses an apparatus for working up existing shoulder aggregate, leveling and then compacting the aggregate. However, any new aggregate material must be laid by a separate piece of equipment and the leveling and compacting device is not adjustable in width. As such, varying conditions, such as differing shoulder widths and mailboxes and roadway signs placed near the roadway cannot be accommodated. U.S. Pat. No. 4,900,185 to Foertsch discloses an asphalt spreader, and, as shown in U.S. Pat. No. 6,612,774 to Dulin, is utilized to spread road shoulder aggregate. However, the '185 patent is also of a fixed width at either of two dimensions. Those being the width of the box if there is no baffle in place, or the distance between the bottom edge of the baffle and a sidewall of the box when the baffle is in place. Furthermore, while the '185 patent allows for straight vertical movement of the apparatus, there is no allowance for any pitch or width adjustment of the shoulder and no allowance for the yaw and vertical rotation of the apparatus relative to the truck when laying asphalt or aggregate. U.S. Pat. No. 4,571,119 to Jones et al. and U.S. Pat. No. 6,089,785 to Bergman have identical problems in that they are not width nor pitch adjustable, nor do they accommodate for any yaw and vertical rotation of the apparatus.

SUMMARY OF THE INVENTION

The exemplary embodiments of the present invention are directed towards the laying, working, grooming and compacting of roadway shoulders while providing for the yaw and vertical rotation of the laying and leveling apparatus relative to the truck and while providing for adjustments for the height, pitch and width of the shoulder. However, it is entirely feasible that the present invention could as easily be utilized for the laying of asphalt with variable heights, widths and pitch while accommodating the yaw and vertical rotation of the apparatus and the roadway relative to the truck.

According to one exemplary embodiment of the invention, there is provided a deployable retractable apparatus configured for demountably cooperating with a self propelled operator controlled machine, preferably a dump truck, for laying an aggregate material at an adjustable width to a roadway or roadway shoulder and spreading the aggregate at the appropriate height, width and pitch to the roadway. The compaction of the aggregate being accomplished by the tires of the self propelled operator controlled machine driven over the aggregate after the aggregate has been laid and leveled.

The apparatus being attached to a dump truck box that is equipped with conveyors or augers to move the aggregate towards an opening in the dump truck box. The apparatus can be mounted either to the rear of a backward dumping dump truck or to the front of a forward dumping dump truck. It can also be mounted in a forward or rearward facing position. In one of the rear mounted embodiments, a square steel bar is inserted horizontally and secured with a pin or fastener to the hitch receiver on the truck frame. If no hitch receiver is available, the apparatus can be secured by attaching a mounting plate to the square steel bar and then fastening the mounting plate to the truck frame. Secured to the square steel bar is a first steel support, shown as a channel, dropping vertically from the square steel bar. Pivotally attached to the lower end of the first steel support is the first end of a first hydraulic cylinder. The first hydraulic cylinder being operably connected to the dump trucks existing hydraulic and control systems, which are well known in the art. As is also well known in the art, the control systems are typically located in the cab of the truck. Pivotally connected to the square steel bar are two (2) frame support bars mounted on either side of the first steel support which is attached to the first square steel bar. The first steel support prevents the frame support bars from sliding horizontally on the square steel bar attached to the truck frame. The outer ends of the frame support bars ending proximate the outer rear tire of the dump truck. Approximately ¾ths down the frame support bars is a second steel support, also shown as a channel, fixed to the two (2) frame support bars to strengthen and maintain the rigidity of the frame support bar structure. A lower pivotal plate is mounted under the second steel support and the second end of the first hydraulic cylinder is pivotably attached to the lower plate.

Secured to the outer ends of the two (2) frame support bars is a connection plate, also shown as channel, through the center of which is a pivot hole. Attached to the pivot hole by a first pivot pin is a rectangular enclosure also shown as made of steel channel although plate, angle iron or tubing would work equally as well. On the rectangular enclosure at the top near both ends is a raised stop bar. This arrangement allows the rectangular enclosure to rotate in a left or right direction until one of the stop bars encounters the connection plate within the range allowed by the two raised stop bars when viewed from the side of the dump truck. In the alternative, the stop bars could be mounted to the connection plate and used to encounter the rectangular enclosure. In another embodiment, the connection plate could be equipped with a stop pin that resides in an enlarged hole in one surface of the rectangular plate. The rotational movement of the rectangular enclosure being constrained by the pin and the size of the enlarged hole.

On the forward and rearward sides of the rectangular enclosure there are second and third pivot holes, respectively. Pivotally mounted by pivot pins into these second and third pivot holes are a forward and rearward support plates extending downward. Fixedly attached to the support plates are an inner and outer runner, both of which are rounded in the front and rear for ease of following the roadway surface. When viewed from the rear of the truck, this arrangement allows for the runners to pivot in a left and right motion to relative to the roadway in relation to the truck. This also allows the leveling apparatus to be pivoted into a vertical position when the apparatus is being transported.

A support brace is fixed to the outer runner at one end of the support brace and to the first part of the leveling plate at the other end through vertically slotted holes in the support brace. There is a height adjusting plate with two through holes and a threaded rod attached to the top of the height adjusting plate. The threaded rod going through an adjusting bar that is fixed to the top of the support brace. A nut on the threaded rod allows a user to raise or lower the height adjusting plate, and thereby the first part of the leveling blade, as a means for adjusting the height of the leveling plate and thereby the height of the aggregate above the road. The aggregate is later compacted evenly with the road way. The support brace being taller than the runners and leveling plate in order to keep the aggregate onto the shoulder and off of the road. The first part of the leveling plate is mounted to the support brace and height adjusting plate at an obtuse angle to the runners with two fasteners, one fastener going through a lower through hole and the other fastener going through an upper horizontally slotted hole in the first part of the leveling plate. By loosening the two fasteners, the first part of the leveling plate can be rotated about the lower fastener and within the range defined by the upper horizontal slot in order to adjust the pitch of the leveling plate to a desired angle. The first part of the leveling plate is hinged proximate to where the support brace is attached to the first part of the leveling plate. There is at least one and preferably two fastening mechanisms, such as a bolt or the like mounted to the first part of the leveling plate.

The second part of the leveling plate has the same height as the first part of the leveling plate but also includes an elongated horizontal slot in the second part of the leveling plate which is adjustably engaged with the fastening mechanisms on the first part of the leveling plate. This allows the operator to adjust the width of the leveling plate assembly and thereby adjust the width of the shoulder being laid. At the outer end of the second part of the leveling plate there is a retaining plate hingedly attached to the outer end. A first adjustable pivotable telescoping length rod connects the outer end of the retaining plate to the inside end of the second part of the leveling plate to secure the position of the retaining plate. This arrangement allows for the adjustment and securing of the angle of the retaining plate to the first and second parts of the leveling plate. A second adjustable pivotable telescoping length rod connects the outside edge of the second part of the leveling plate proximate the front of the outer runner. This arrangement allows for the adjustment and securing of the angle of the leveling plates in relation to the runners.

During transportation of the apparatus, the hydraulics are activated which raises the frame support bars and the attached runners and leveling plates off of the ground surface. The operator then manually pivots the runners and leveling plates upward and secures them in place with a locking mechanism for transportation. In an alternative embodiment, a second hydraulic cylinder could be pivotably attached to the frame support bars and to the runners so that the operator could use the truck's existing hydraulics and controls to raise the runners and leveling plates to secure them in place for transportation.

Once at the work site, the operator lowers the runners and leveling plates and then lowers the frame support bars such that the runners are resting on the roadway. An auger or conveyor belt is mounted to the rear of the dump truck box for unloading the aggregate from the dump truck box. The operator then lowers a chute which is rotatably deployed beneath the auger or conveyor belt opening in order to accept the aggregate and direct the aggregates' deposition between the outer runner, the leveling plate assembly and the outer retaining plate. As aggregate fills the space, the operator slowly backs down the roadway depositing and leveling the aggregate. Once the aggregate is deposited and leveled, the apparatus is returned to its transportation mode and the operator drives the trucks tires over the aggregate to compact the aggregate. In the alternative, the leveling portion of the apparatus could be reversed such that the operator drives forward to lay and level the aggregate.

For areas that require a deeper fill of aggregate, the leveling assembly and retaining plate can be adjusted from an obtuse angle to an acute angle, with the retaining plate being repositioned more or less parallel with the runners. This position causes more material to be forced upward towards the road to allow for a greater amount of aggregate deposition nearer the road. The retaining plate keeps any loose aggregate up on the shoulder when laying the aggregate.

This apparatus allows for a one person operation for shoulder creation, maintenance and repair. For those communities with salting/sanding and snow plowing trucks, those same vehicles can be easily and quickly converted for shoulder placement, repair and maintenance as the salting and sanding dump trucks easily handle the aggregate as well. The end result being better roadway shoulders at less cost. It further provides for adjustable shoulder widths, adjustable shoulder heights, adjustable shoulder pitch, adjustable shoulder depth and allowance for the yaw and vertical rotation of the apparatus in relation to the roadway and truck while in operation.

Other features and advantages of this disclosure will become apparent to one skilled in the art upon examination of the following drawings and detailed description. It is intended that all such additional features and advantages be included within the scope of the present invention as defined by the appended claims.

BRIEF DESCRIPTION OF THE DRAWINGS

A system and a method according to the invention will be described in more detail by means of a preferred embodiment with reference to the appended drawings in which.

DETAILED DESCRIPTION OF THE PREFERRED EMBODIMENTS

Figure 1:
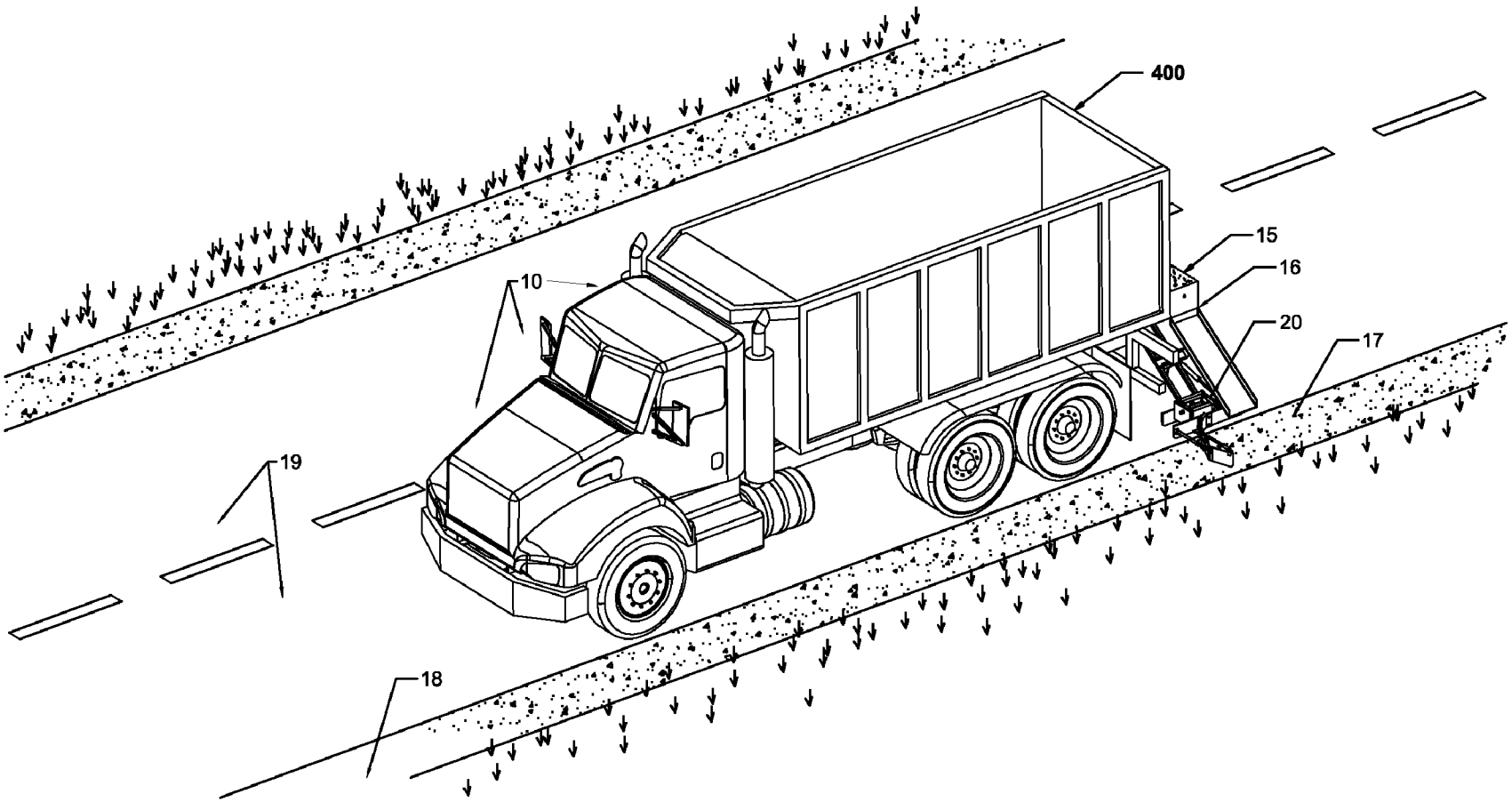
FIG. 1 is a perspective view of a rearward dumping dump truck equipped with a distribution chute and the present invention in a first embodiment in its deployed position.

Reference will now be made in detail to the description of the invention as illustrated in the drawings. Although the invention is described in connection with the drawings, there is no intent to limit the invention to the embodiment or embodiments disclosed therein. On the contrary, the intent is to include all alternatives, modifications, and equivalents included within the scope and spirit of the invention as defined by the appended claims. However, the invention and its alternatives, modifications, derivatives and/or equivalents in other applications are meant to be included within the scope and spirit of the invention as defined by the appended claims. For example, but without limitation, the invention has been described using channel, however, flat steel stock and/or angle iron can readily be substituted for channel. Similarly, the hitch bar could be solid or tubular and alternatives to the use of pivot pins, such as rotational sockets, and other means well known in the art, could be substituted without detracting from the form, intent and purpose of the present invention. Similarly, electrical servo-motors could be utilized in place of the hydraulic cylinders where the dump trucks do not have hydraulic systems and controls.

Referring to FIG. 1, there is depicted a rear dumping dump truck 10 with the adjustable laying and leveling apparatus 20 of the present invention, in its deployed position, mounted to the rear of the dump truck 10. The truck has a bulk material receiving dump bed 400, an aggregate feeding mechanism or auger 15 and an aggregate material applicator or distribution chute 16 also attached to the rear of the dump truck 10. The aggregate 17 is depicted on the shoulder 18 of the roadway 19.

Figure 2:
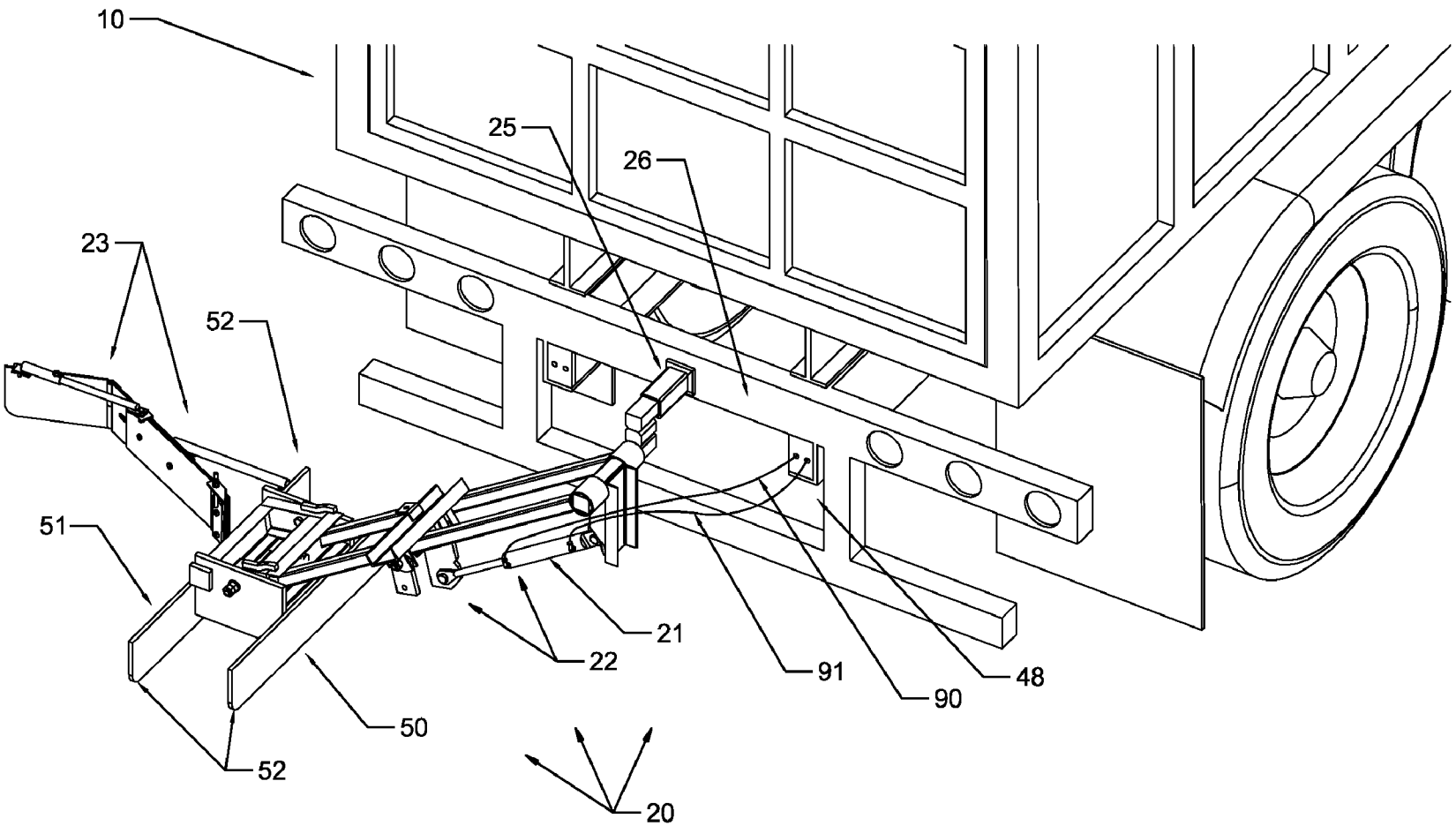
FIG. 2 is a first perspective view of the present invention from the rear of the dump truck depicting the invention with only one hydraulic cylinder and without the chute being present so as not to obscure the view.
Figure 3:
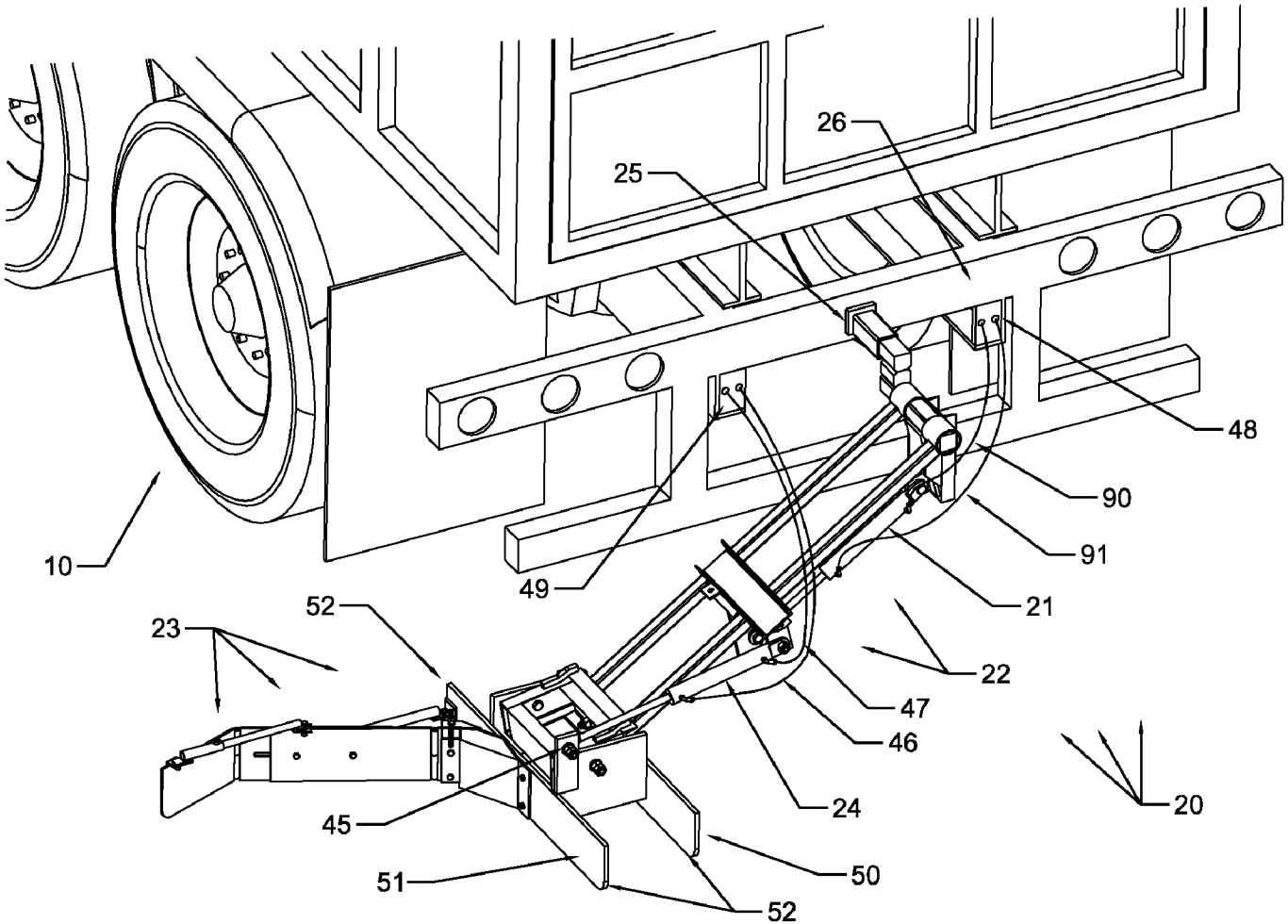
FIG. 3 is a second perspective view of the present invention from the rear of the dump truck depicting the invention with two hydraulic cylinders and without the chute being present so as not to obscure the view.

FIGS. 2 and 3 depict the adjustable laying and leveling apparatus 20 of the present invention in two embodiments respectively. FIG. 2 depicts the distribution and leveling apparatus 20 with a first hydraulic cylinder 21 for use in raising and lowering the frame mounting portion 22 of the present invention 20. The auger 15 and distribution chute 16, which are well known in the art, are not shown in order to more clearly depict the distribution and leveling apparatus 20. As shown in FIG. 2, the distribution and leveling portion 23 of the present apparatus 20 has to be manually raised and secured for transportation and manually lowered to its deployed position. FIG. 3 depicts the distribution and leveling apparatus 20 with the first hydraulic cylinder 21 for raising and lowering the frame mounting portion 22 and a second hydraulic cylinder 24 for raising and lowering the distribution and leveling portion 23 of the present apparatus 20. In both FIGS. 2 and 3, the distribution and leveling apparatus 20 is depicted as secured to the dump truck 10 through a hitch receiver 25 mounted to the trucks frame 26.

Figure 4:
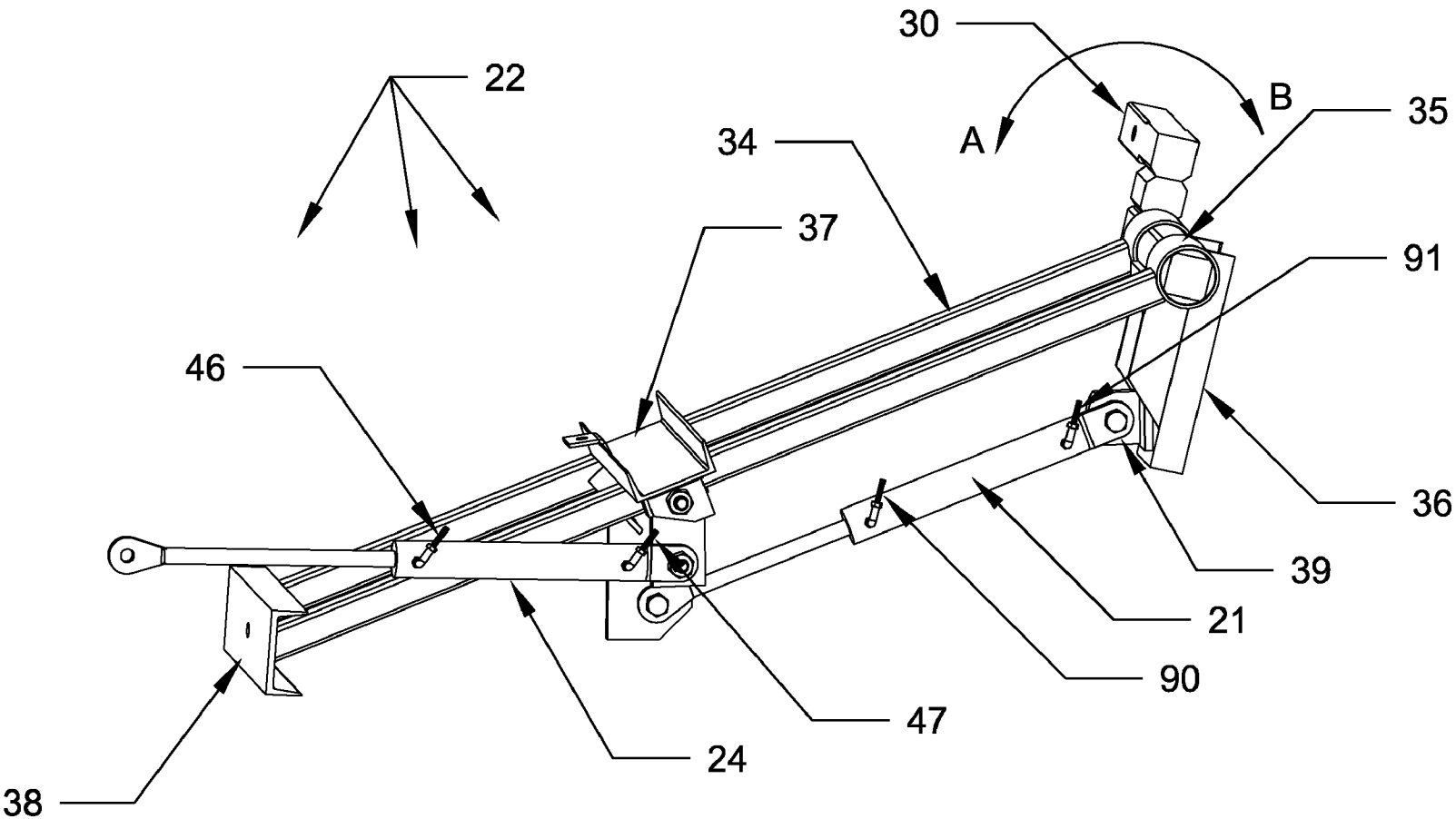
FIG. 4 is a perspective view of the frame mounting portion of the present invention showing the rotational movement "A-B".
Figure 5:
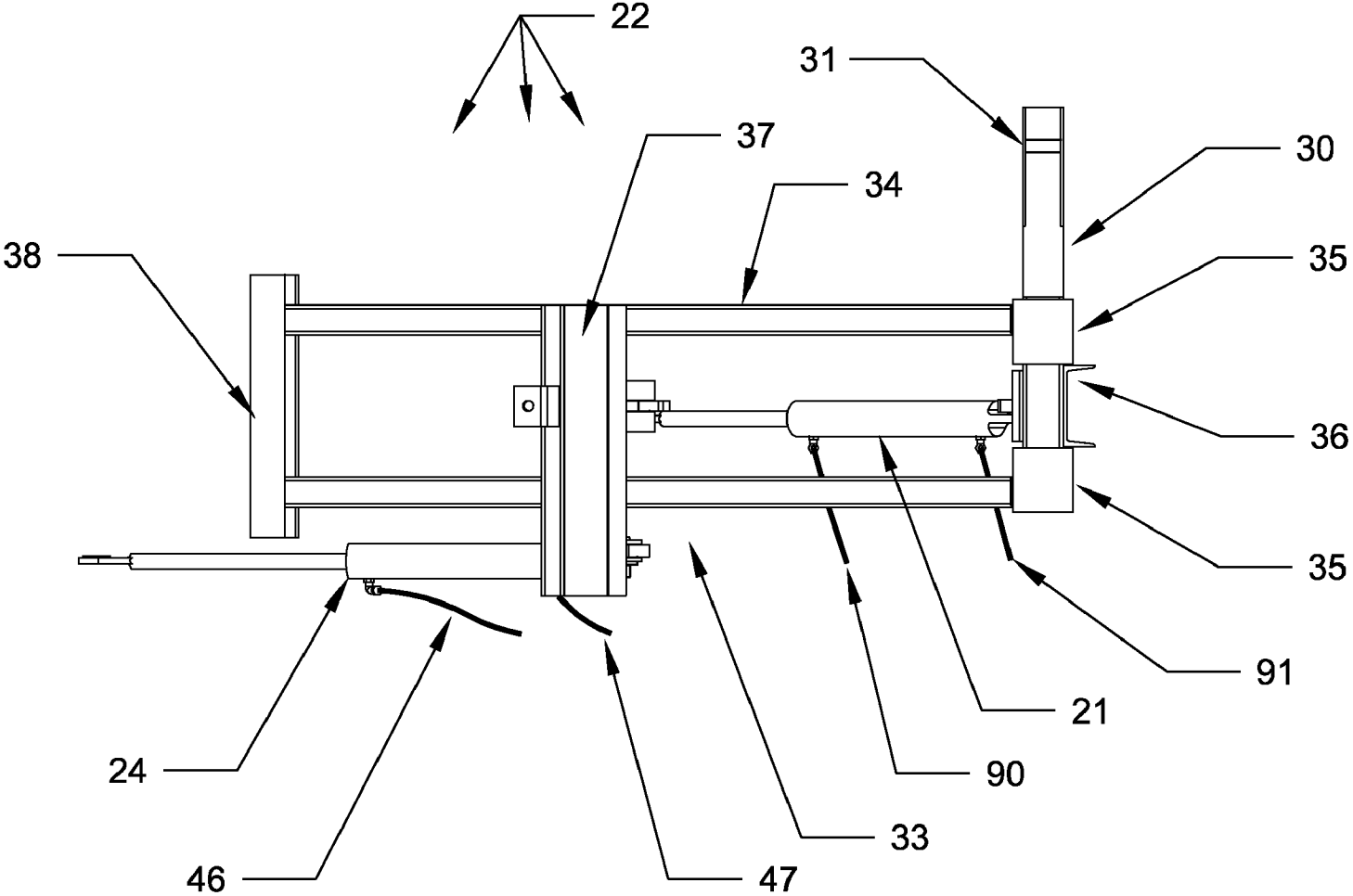
FIG. 5 is a first top planar view of the frame mounting portion of the present invention when used with a hitch receiver of a truck frame.
Figure 6:
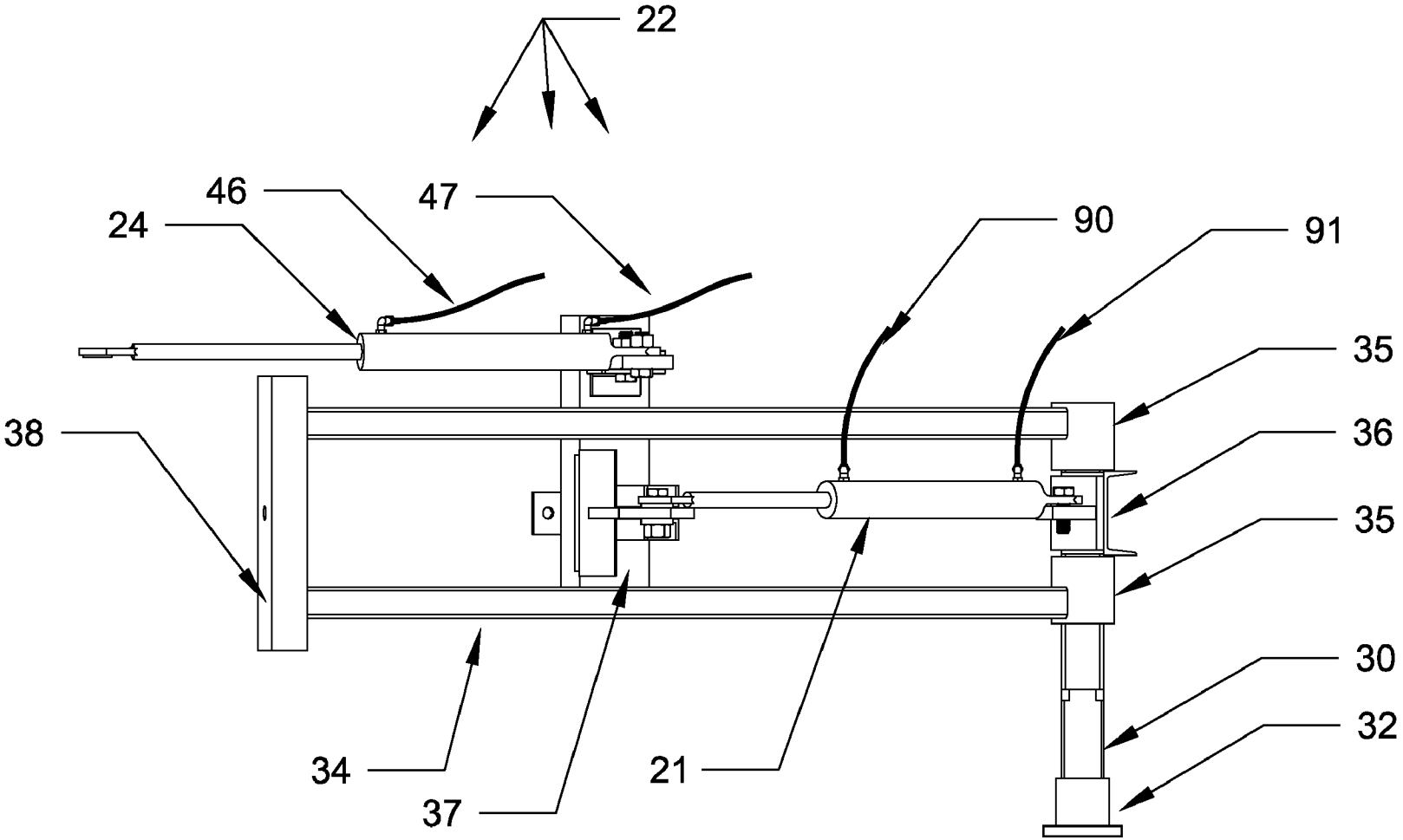
FIG. 6 is a bottom planar view of the frame mounting portion of the present invention when used with a flange for mounting to a truck frame with no hitch receiver.
Figure 20:
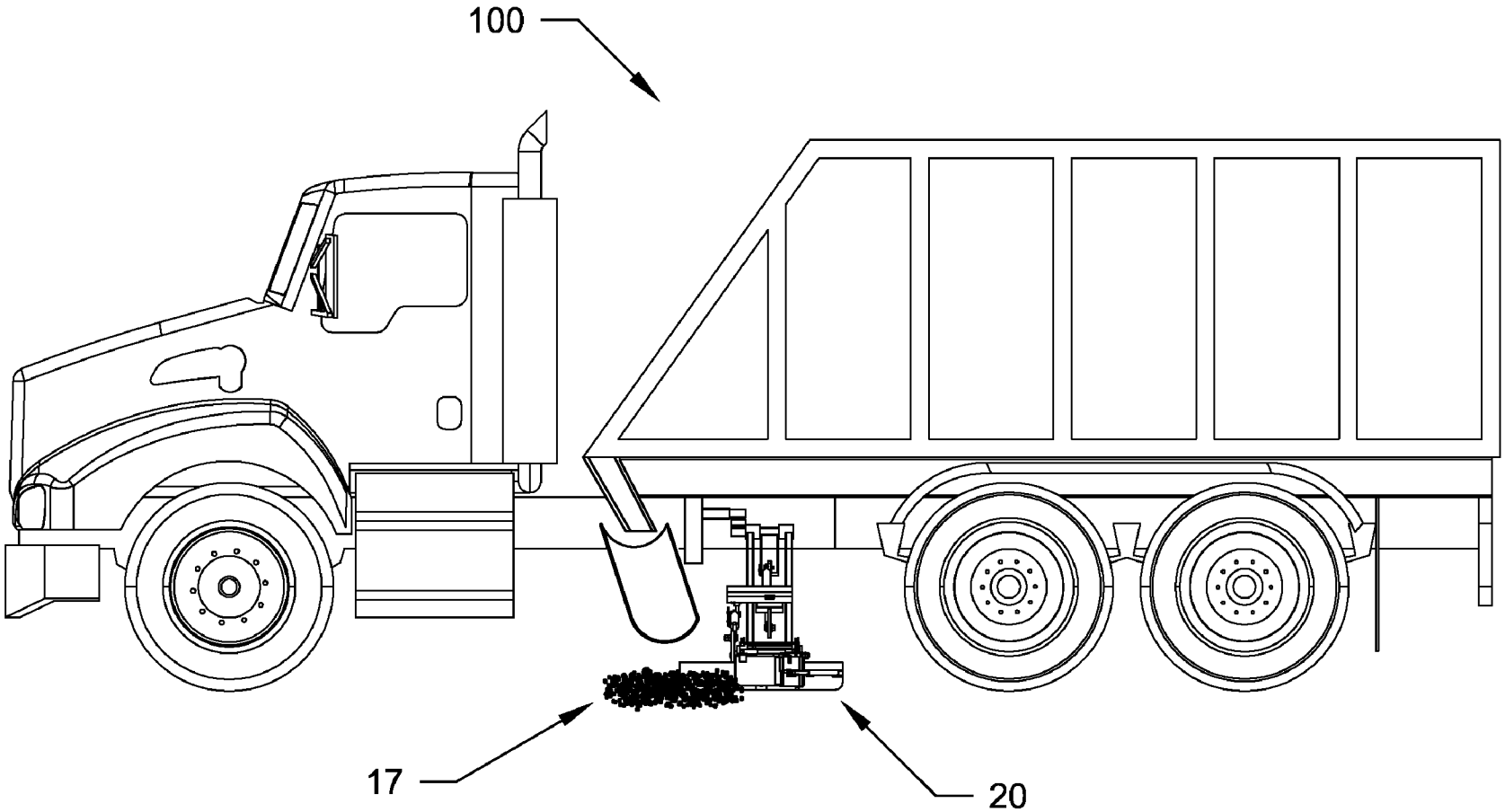
FIG. 20 is a side planar view of the present invention deployed in a forward facing position when used by a front unloading dump truck.

FIGS. 4, 5, 6 and 7 depict the frame mounting portion 22 of the distribution and leveling apparatus 20. FIG. 4 is a view of the frame mounting portion 22 when viewed from the rear of the dump truck 10. FIGS. 5 and 6 are top and bottom views, respectively, of the frame mounting portion 22. The frame mounting portion 22 includes a drop down style hitch bar 30. If the dump truck 10 has a receiver 25, then the hitch bar 30, as shown in FIG. 5, can be inserted horizontally into the receiver 25 and secured to the truck 10 by a lock pin or fastener (not shown) going through the receiver 25 and through the through hole 31 in the hitch bar 30. If the dump truck 10 has no receiver, then, as depicted in FIG. 6, a mounting flange 32 can be attached to the hitch bar 30 and the mounting flange 32 then secured to the dump truck frame 26 either at the rear of the truck 10 for a rear dumping dump truck 10 or proximate the front of the dump truck box for a forward dumping dump truck 100 as shown in FIG. 20.

There are two frame support bars 33 and 34. To a first end of each frame support bars 33 and 34, there is fixedly attached two horizontal open-ended tubes 35. The open-ended tubes 35 are slid over the hitch bar 30 such that the frame support bars 33 and 34 can rotate about the direction shown in FIG. 4 as the arrow "A-B". Fixedly attached to the hitch bar 30 is a vertically mounted first support 36 depending downward from the hitch bar 30 and in between the open-ended tubes 35 on the frame support bars 33 and 34. A second support 37 is fixedly attached to both frame support bars 33 and 34 approximately three fourths down the length of the frame support bars 33 and 34 thereby forcing the two frame support bars 33 and 34 to rotate in unison about the hitch bar 30. A connection plate 38 is fixedly attached to the second ends of the frame support bars 33 and 34 at an angle. The first support 36 prevents the joined frame support bars 33 and 34 from coming off of the hitch bar 30.

At the bottom end of the first support 36 there is a first flange 39 for rotatably connecting the first end of a first hydraulic cylinder 21. Shown in FIG. 7 attached to the second supports 37, there are fixedly attached four (4) second flanges 41. A first rotatable pivot plate 42 is secured in between the first two second flanges 41 by pivot pin 43 (not shown). The second end of the first hydraulic cylinder 21 is rotatably attached to the pivot plate 42 by pivot pin 44. The first hydraulic cylinder 21 being operably coupled to hydraulic hoses 90 and 91 at a first end and the second ends of the hydraulic hoses 90 and 91 being operably coupled to the hydraulic system 48 of the truck 10 shown in FIGS. 2 and 3. Applying hydraulic pressure to either hydraulic hose 90 and 91 causes the hydraulic cylinder 21 to either expand or withdraw thereby either raising or lowering the second end of the frame support bars 33 and 34 by pivoting the frame mounting portion 22 about the hitch bar 30.

Figure 7:
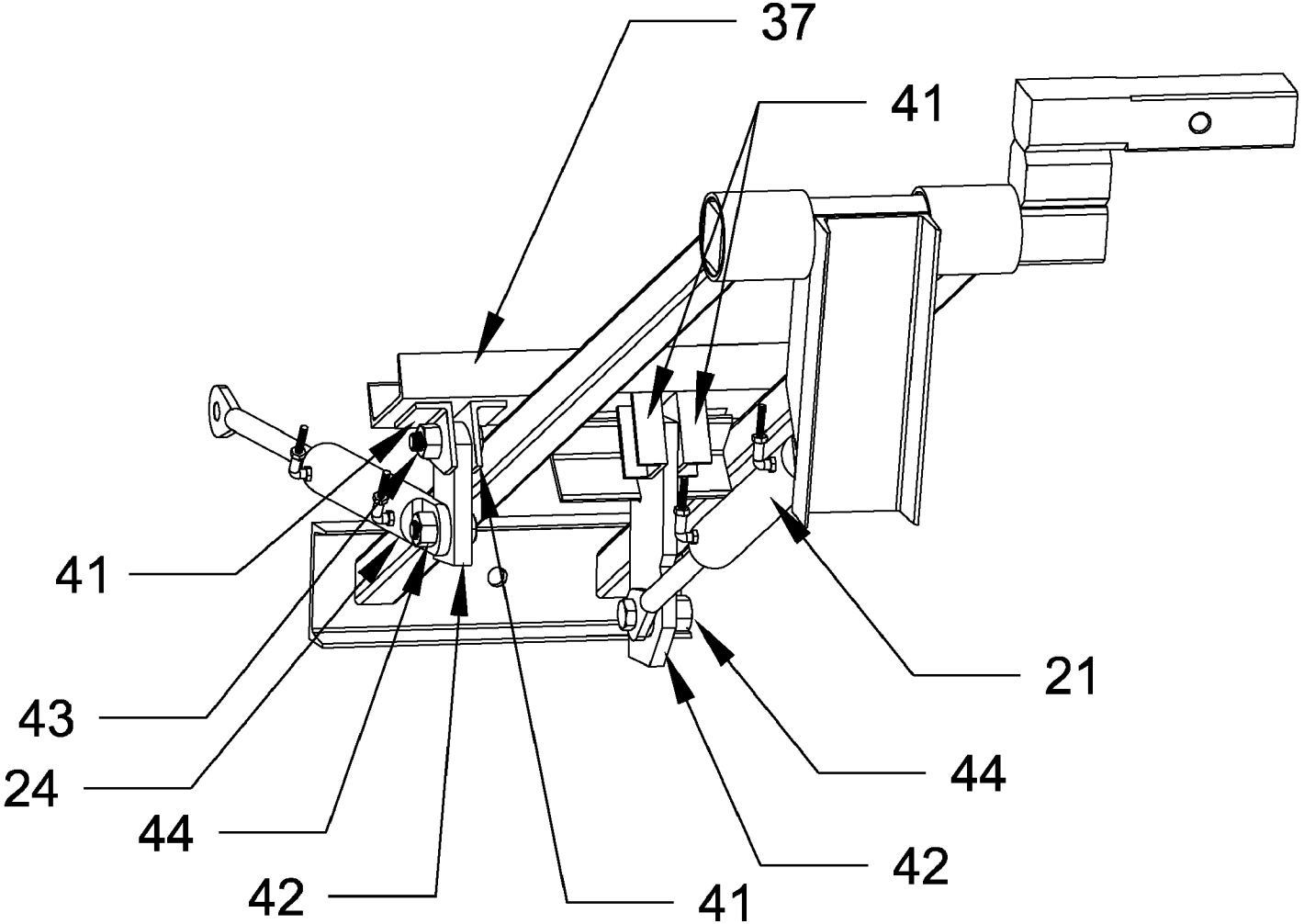
FIG. 7 is a perspective view of the pivoting hydraulic cylinders connection to the second channel.

In an alternative embodiment, there is a second hydraulic cylinder 24 rotatably connected at a first end to a flange 45 fixedly attached to the leveling portion 23 of the apparatus 20 as shown in FIG. 3. The second end of the second hydraulic cylinder 24, as shown in FIG. 7, is connected to a second swivel plate 42 by pivot pin 44. The swivel plate 42 being pivotably attached to the second two second flanges 41 which are fixedly attached to the second support 37. The hydraulic hoses 46 and 47 being operably connected at a first end to the second hydraulic cylinder 24 and the second end of the hydraulic hoses 46 and 47 being operably connected to the hydraulic system 49 of the truck shown in FIG. 3. Applying hydraulic pressure to either hydraulic hose 46 or 47 causes the hydraulic cylinder 24 to either expand or withdraw thereby either raising or lowering the distribution and leveling portion 23 of the present apparatus 20.

Figure 8:
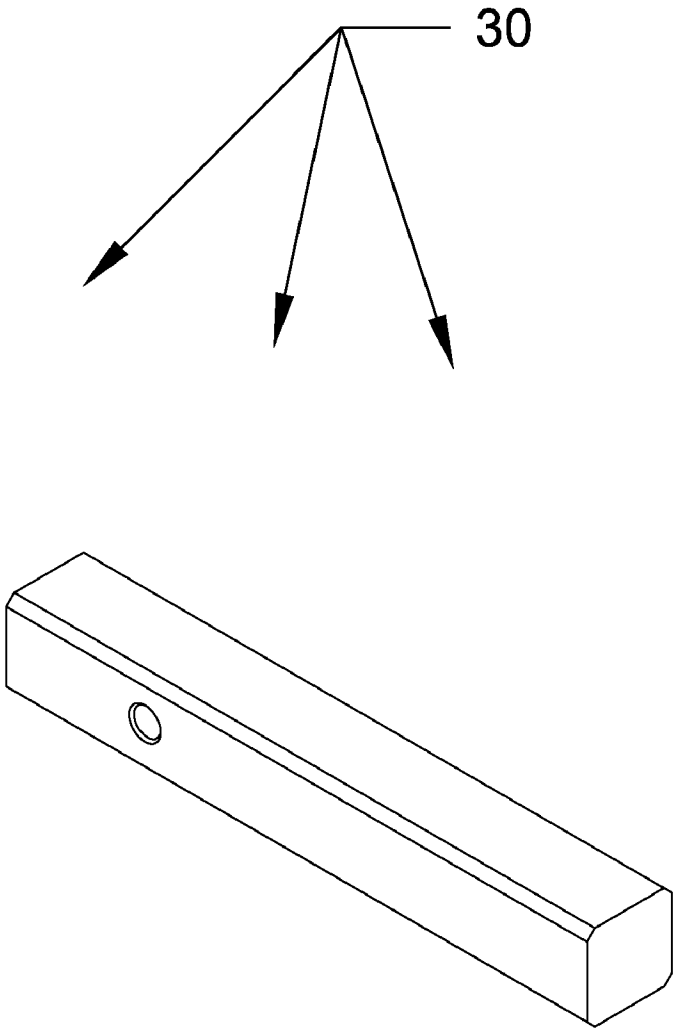
FIG. 8 is a perspective view of an alternate straight style hitch bar.

FIG. 8 depicts a perspective view of an alternative straight style of hitch bar 30. This style could be utilized in place of the drop down hitch bar 30 shown in FIGS. 2, 3, 4 and 6 if the drop down style hitch bar was unnecessary.

Figure 9:
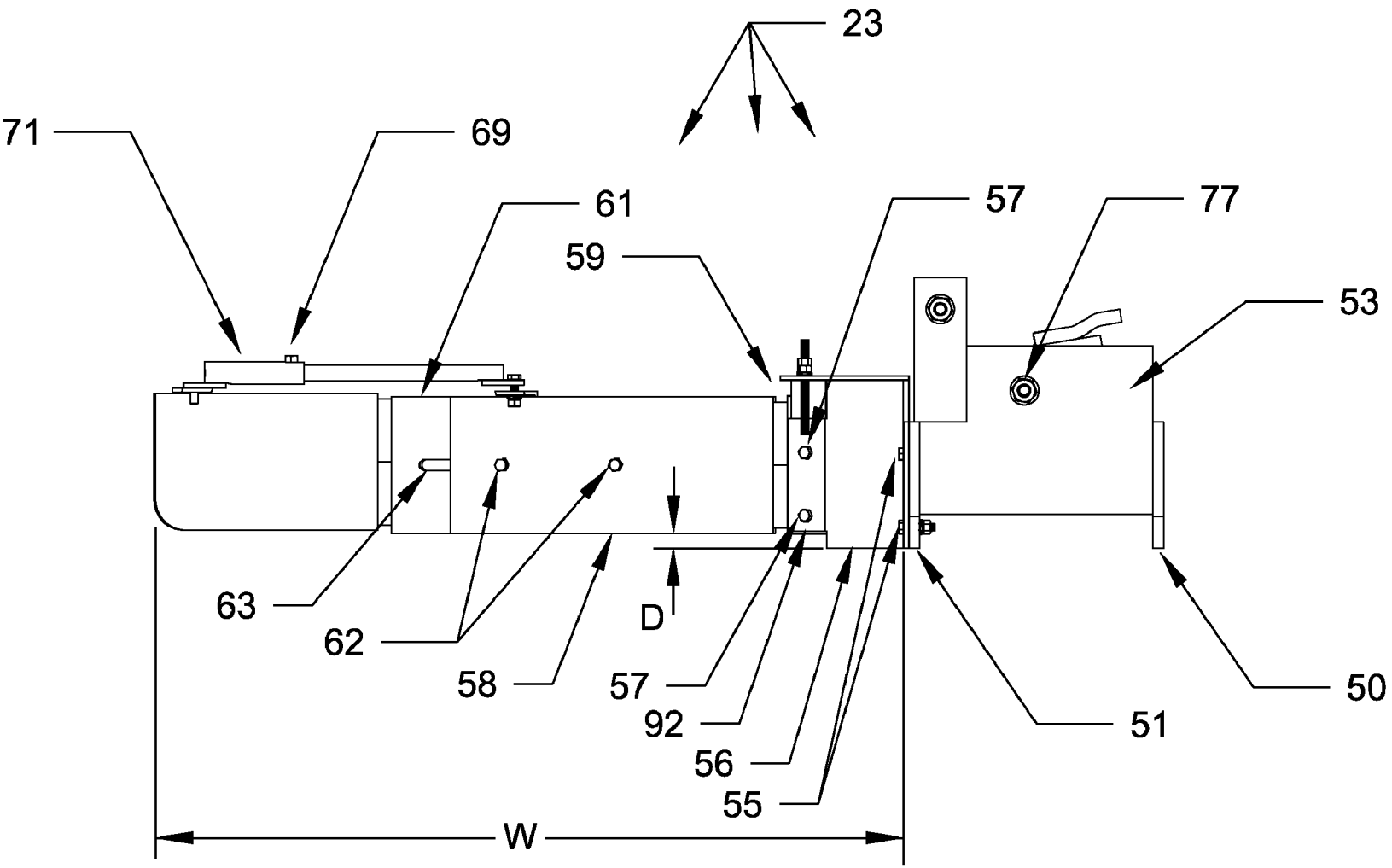
FIG. 9 is an end planar view of the distribution and leveling portion of the present invention.
Figure 10:
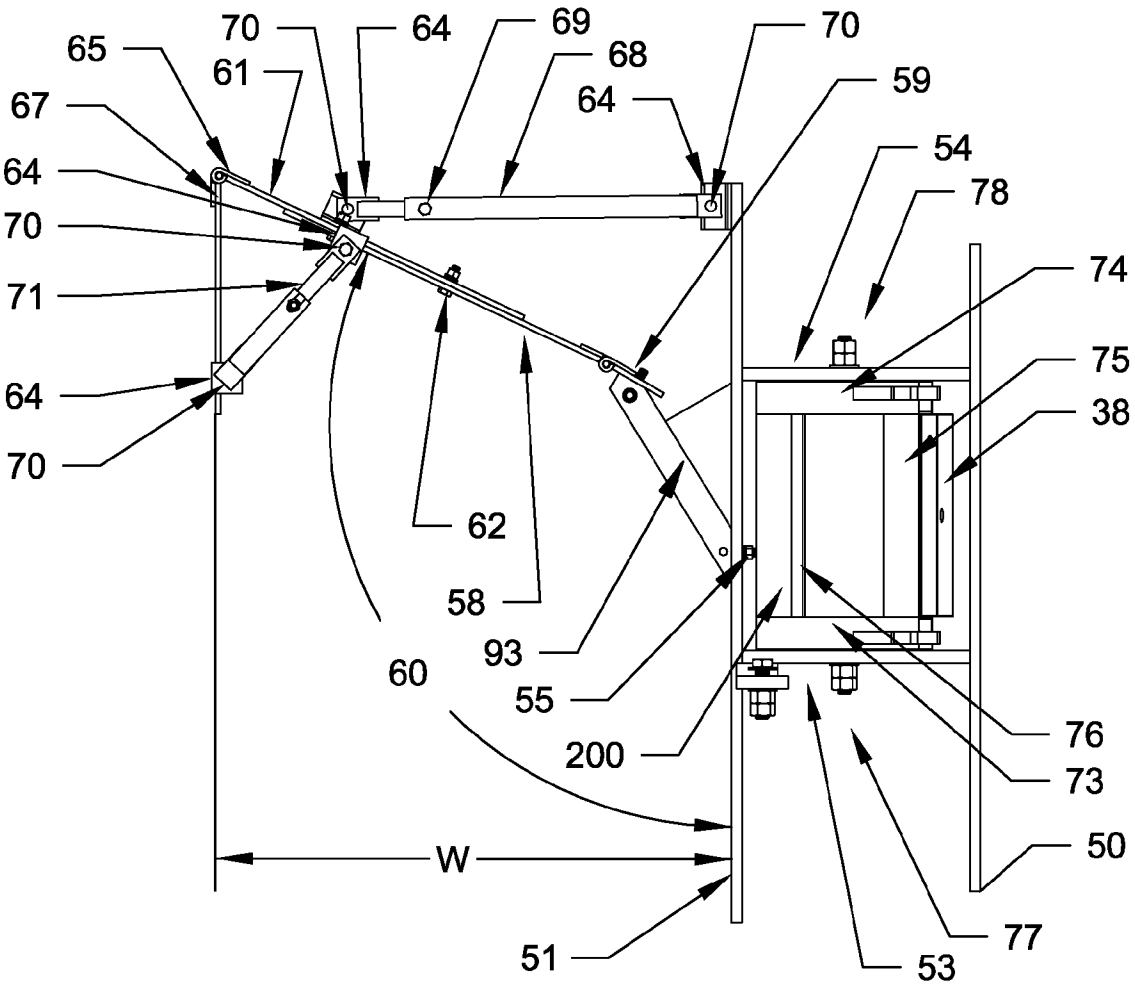
FIG. 10 is a first top planar view of the distribution and leveling portion of the present invention with the leveling blade at an obtuse angle to the runners and in a rearward facing position.
Figure 11:
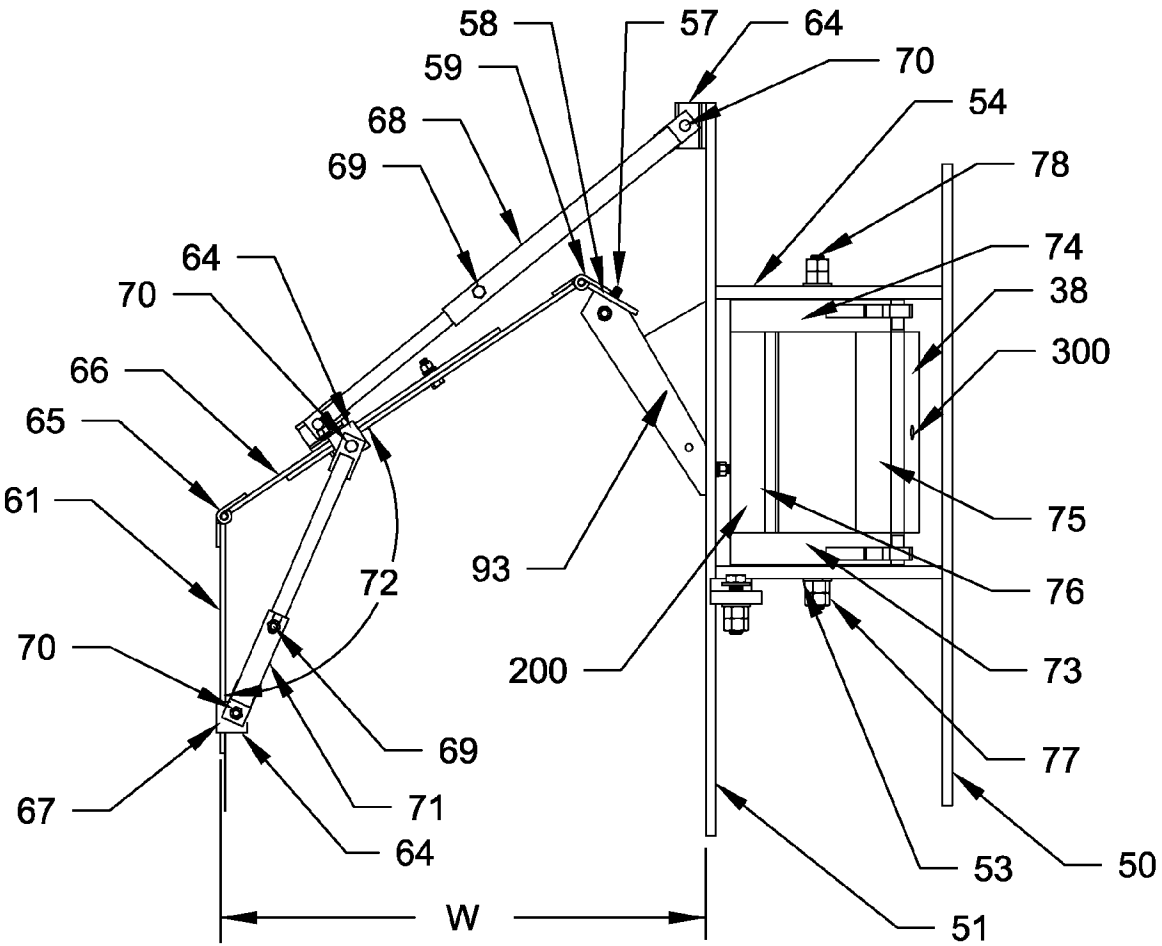
FIG. 11 is a second top planar view of the distribution and leveling portion of the present invention with the leveling blade at an acute angle to the runners.

FIGS. 9, 10 and 11 depict several views of the distribution and leveling portion 23 of the present apparatus 20. FIG. 9 is an end planar view of the distribution and leveling portion 23 of the apparatus 20. There are inner and outer runners 50 and 51 respectively, which, when the apparatus 20 is deployed, rest on the roadway surface 19 as shown in FIG. 1. The leading and trailing edges 52 of the runners 50 and 51 being curved, as shown in FIGS. 2 and 3, to allow the distribution and leveling portion 23 to ride smoothly over the roadway surface 19. Fixed in between the runners 50 and 51 are first and second vertical plates 53 and 54 respectively. Attached to the outer runner 51 by fasteners 55 is a support brace 56. Adjustably connected to the support brace 56 by fasteners 57 is the first half of the distribution and leveling blade 58 and the height adjustment plate 92. The first half of the distribution and leveling blade 58 being pivotably hinged 59 proximate the support brace fasteners 57. This allows the first half of the distribution and leveling blade 58 to have an adjustable angle 60 as depicted in FIG. 10.

The second half of the distribution and leveling blade 61 is adjustably coupled to the first half of the distribution and leveling blade 58 by fasteners 62. The adjustability of the width "W" of the shoulder 18 is accomplished by loosening both telescoping rods 68 and 71 by loosening the telescoping rod set screws 69 and loosening the fasteners 62. The operator then repositions the second half of the distribution and leveling blade 61 to the desired width "W" and retightening the fasteners 62 through the elongated slot 63 in the first and second half of the distribution and leveling blades 58 and 61.

The second half of the distribution and leveling blade 61 is pivotably hinged 65 proximate the middle of the second half of the distribution and leveling blade 61, thereby creating an inner distribution and leveling blade 66 and an outer aggregate retention blade 67. Once the first half of the distribution and leveling blade 58 has been set to the desired angle 60, the angle 60 is adjustably fixed in place by a first telescoping rod 68 which is pivotally attached with a first pivot pin 70 and bracket 64 at a first end to the outer runner 51 and at a second end to the second half of the distribution and leveling blade 61 by a second pivot pin 70 and a bracket 64. The telescoping rod 68 is held in position by a set screw 69.

Similarly, the angle 72 of the inner distribution and leveling blade 66 and the aggregate retention blade 67 is adjustable by means of the hinge 65 and is adjustably held in place by a second telescoping rod 71 which is pivotally attached at a first end to the aggregate retention blade 67 by a third pivot pin 70 and bracket 64 and at a second end to the inner distribution and leveling blade 66 by a fourth pivot pin 70 and bracket 64.

As should be apparent from the description, in combination with the drawings, both angle 60 of the distribution and leveling blades 58 and 61 and the width "W" between the outer runner 51 and the aggregate retention blade 67 are adjustable. This arrangement provides for the creation of variable width shoulders (distance "W") either by lengthening or shortening the first telescoping rod 68 or by repositioning the second half of the distribution and leveling blade 61 in relation to the first half of the distribution and leveling blade 58 by the fasteners 62. Furthermore, by changing the angle 60 to an acute angle by adjusting the first half of the distribution and leveling blade 58, the aggregate 17 is forced upward towards the outer runner 51 to provide for a deeper fill of aggregate 17 nearer the roadway 19.

In addition, the distribution blades 58 and 61 and the aggregate retention plate 67 can be set in a straight line for leveling in which event any excess aggregate 17 is pushed out past the shoulder 18.

Figure 12:
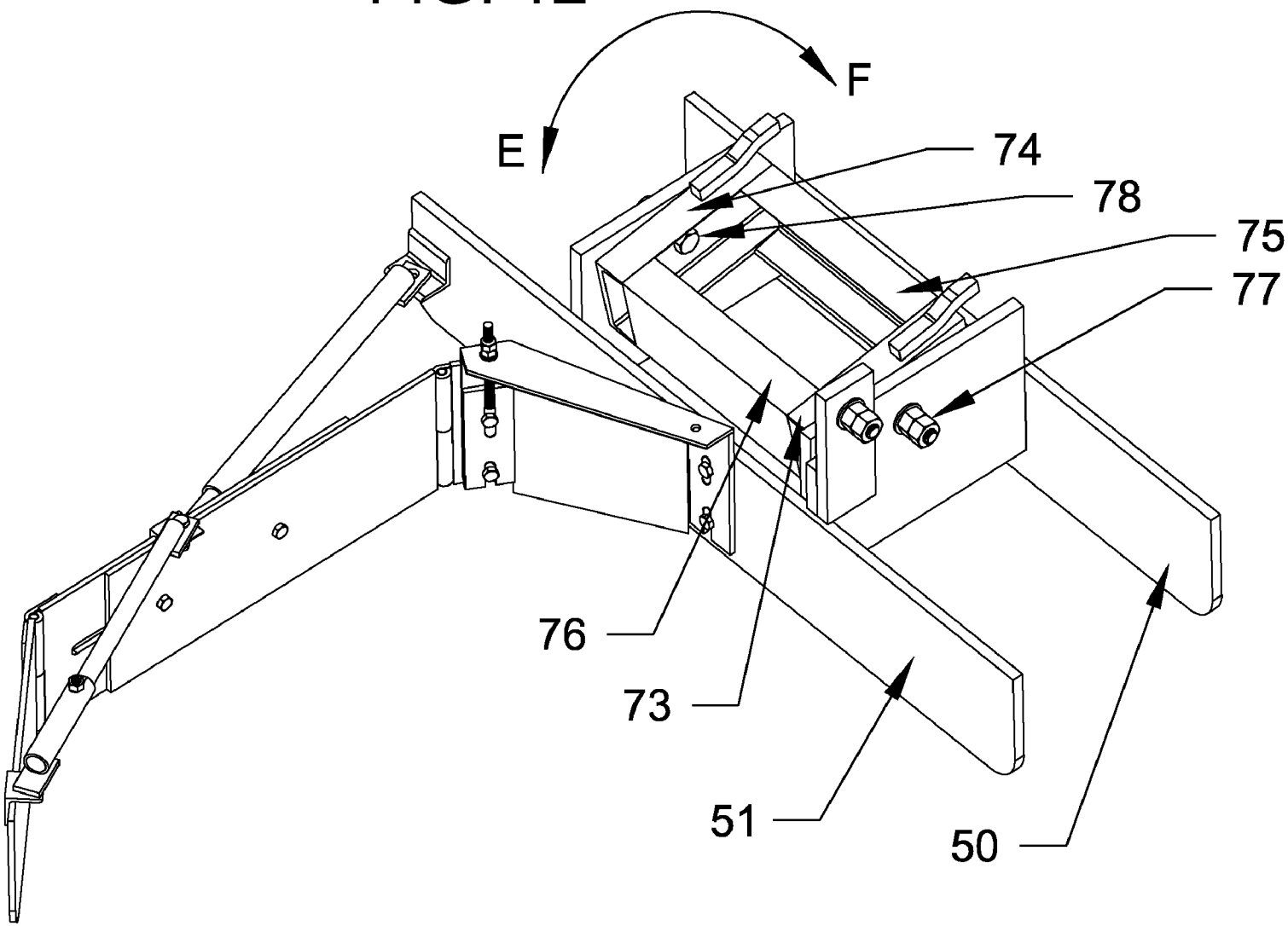
FIG. 12 is a perspective view of the distribution and leveling portion of the present invention showing the relative rotational movement E-F, between the inner frame structure and distribution and leveling portion of the present invention.
Figure 13:
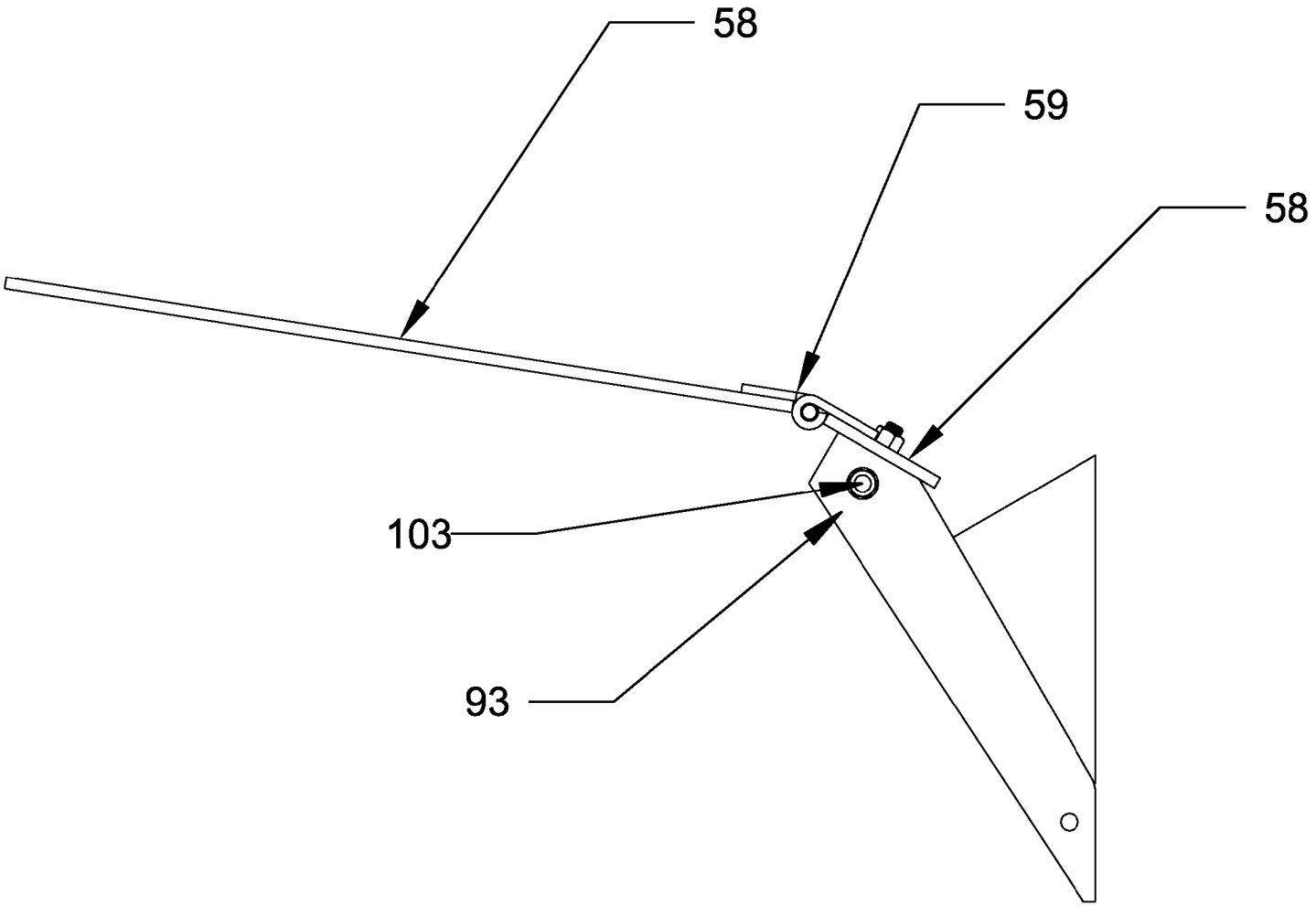
FIG. 13 is a top planar view of the first part of the leveling plate and the height adjusting bar.
Figure 14:
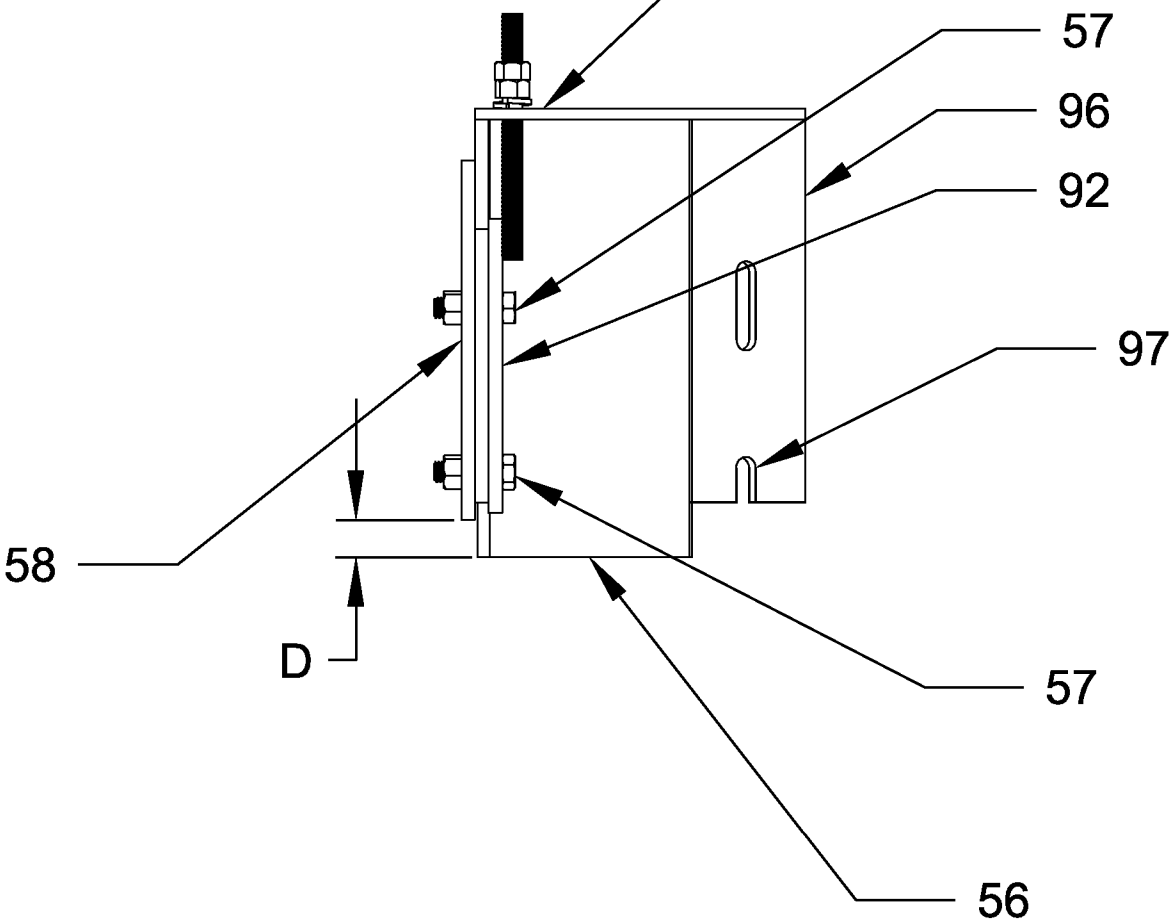
FIG. 14 is a side planar view of the first part of the leveling plate, the support brace and the height adjusting bar.
Figure 15:
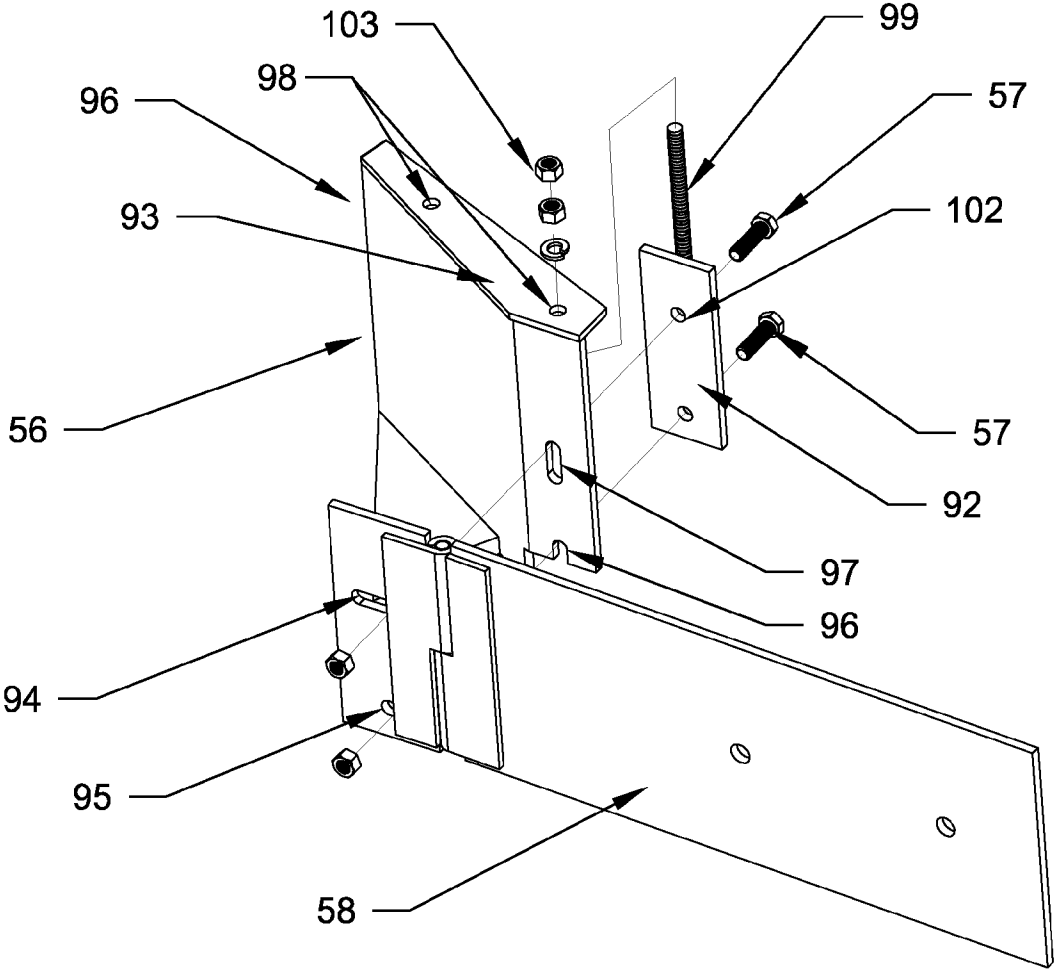
FIG. 15 is a perspective view of the assembly of the first part of the leveling plate, the support brace and the height adjusting bar.

FIGS. 10 and 11 further depict an inner frame structure 200 consisting of four channels 73, 74, 75, and 76 fixedly attached to each other to form an open rectangle with sufficient space between the two channels 75 and 76 and the inner and outer runners 50 and 51 to allow the inner frame structure to rotate inside the void created by the runners 50 and 51 and the vertical plates 53 and 54 about the pivot points 77 and 78 which pivotally connect channels 73 and 74 to the vertical plates 53 and 54. The inner structure 200 could be made of flat stock, angle iron or a combination thereof. FIG. 12 is a perspective showing the direction of rotation "E-F" of the channels 73, 74, 75 and 76 in relation to the runners 50 and 51. The hole 300 in channel 75 being used to rotatably connect the inner frame structure 200 to the connection plate 38 with a pivot pin.

Figure 21:
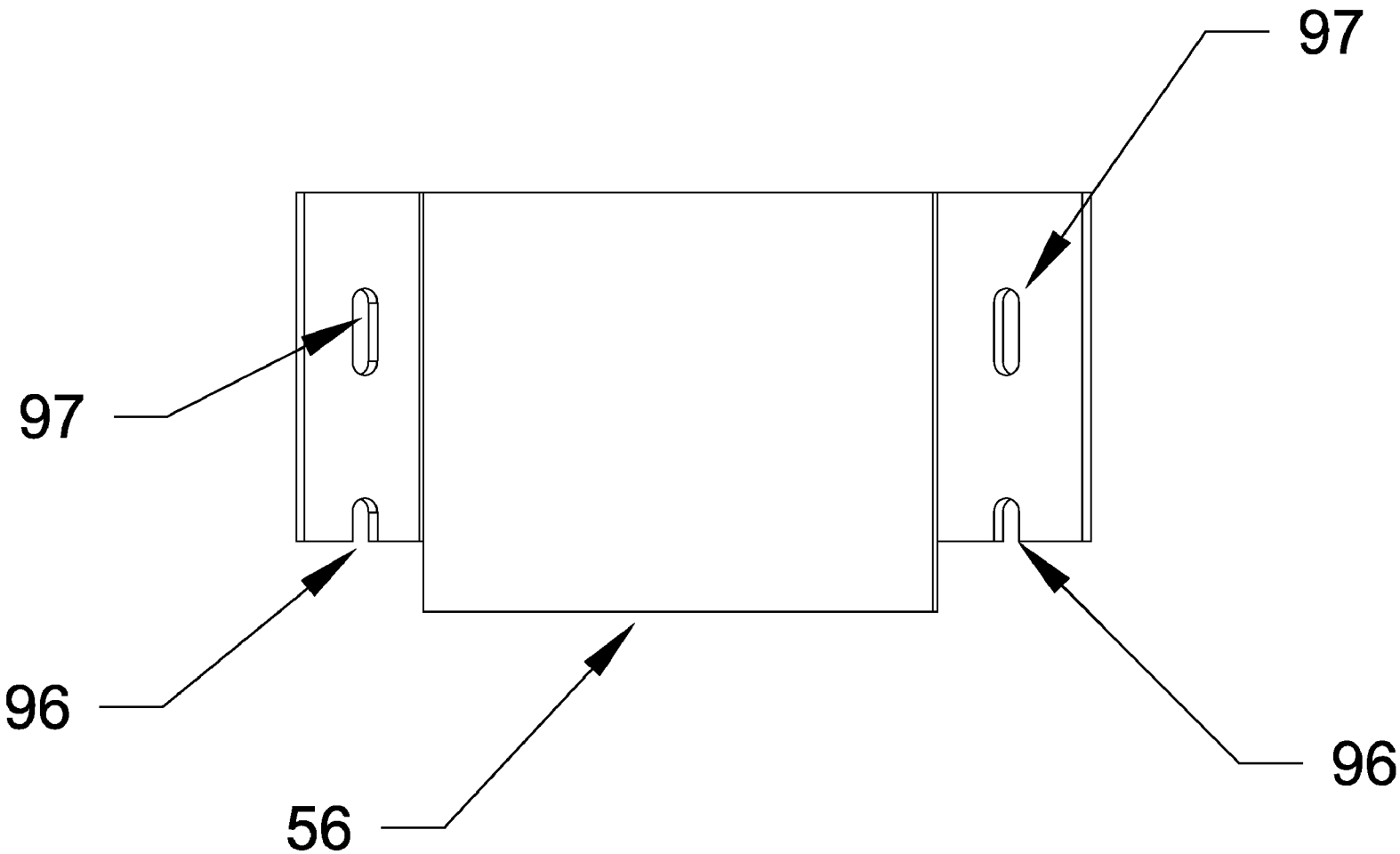
FIG. 21 is a planar view of the support brace.

FIGS. 9, 13, 14, 15 and 16 depict the distribution and leveling apparatus 23 with the height "D" and pitch "P" adjustments. Sandwiched in between the height adjustment plate 92 and the inner distribution and leveling blade 58 is the support brace 56. The inner distribution and leveling blade 58 having an upper horizontal slotted hole 94 and a lower through hole 95. The support brace 56 having two open ended vertical slots 96 and two vertical slotted holes 97 as shown in FIG. 21. Fixed to the top of the support brace 56 is an adjustment bar 93 with two through holes 98. The height adjusting plate 92 has a threaded rod 99 attached to one end and two through holes 102 in the adjusting plate 92. The threaded rod 99 goes through one hole 98 in the adjustment bar 93, depending upon if the apparatus 20 is positioned in a forward or rearward operating position, with a nut 103 on the end of the threaded rod 99. By loosening the fasteners 57, an operator can change the height "D" of the amount of aggregate 17 leveled above the roadway 19 by turning the nut 103 which causes the height adjusting plate 92 to move up or down. Once the height "D" has been set, the operator can seize the inner distribution and leveling blade 58 and adjust the pitch "P" of the leveling blade 58 and 61 by pivoting about the fastener 57 in the hole 95 within the limits of the fastener 57 in horizontal slot 94 in the first part of the leveling blade 58. The fasteners 57 can then be tightened to maintain the height "D" setting and the pitch "P" setting. This allows an operator to set a desired height of aggregate 17 above the roadway 19 surface such that when the aggregate 17 is compacted later, the end result is a compacted shoulder even with the roadway 19 and pitched P away from the roadway surface 19.

Figure 16:
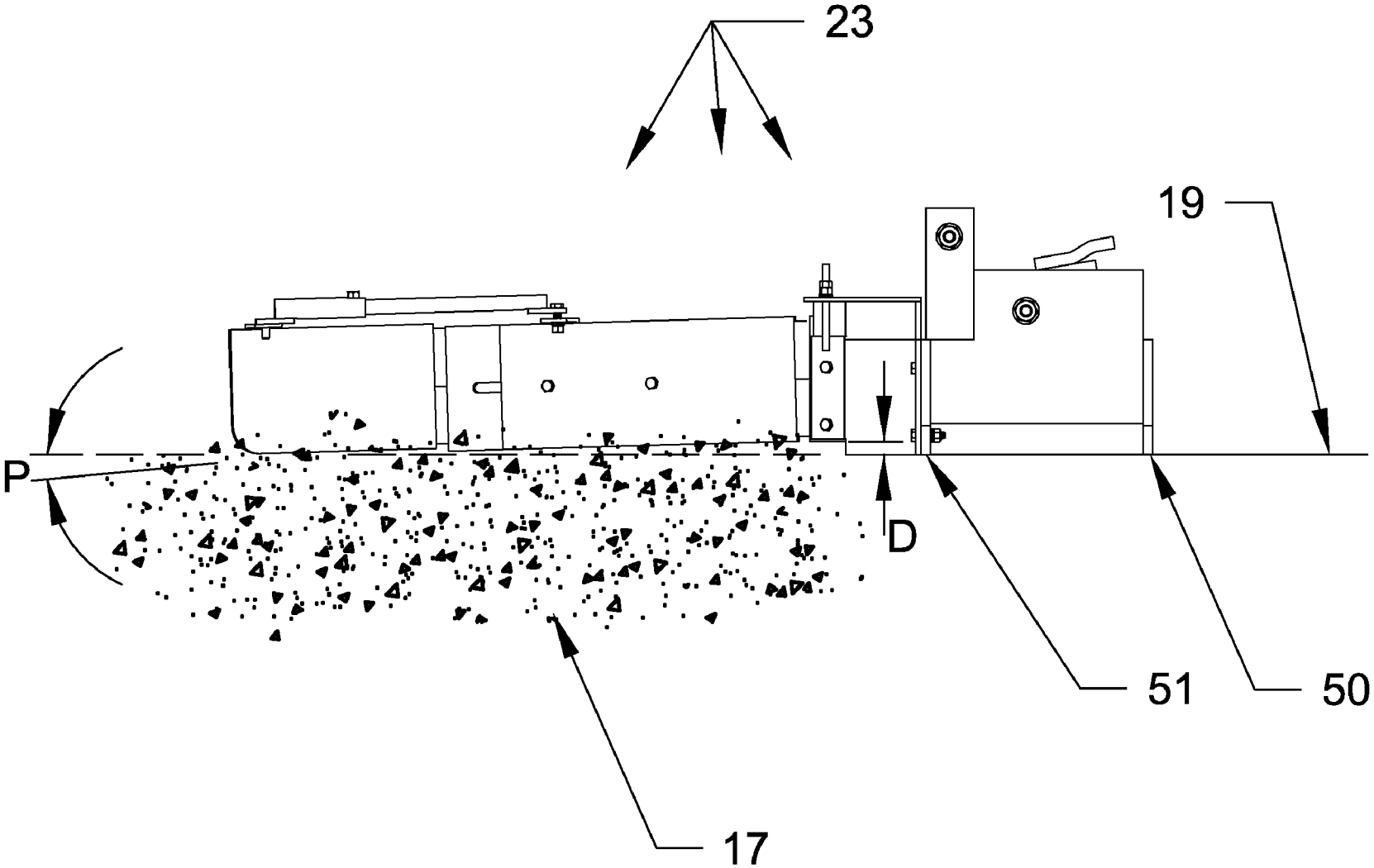
FIG. 16 is an end planar view of the leveling portion of the present invention depicting the loose aggregate being leveled at a pitch to the road surface and slightly higher than the road surface.

FIG. 16 depicts the distribution and leveling portion 23 positioned on a roadway 19 with the un-compacted aggregate 17 leveled and at a pitch "P" to the roadway 19 surface to allow for water and debris runoff.

Figure 17:
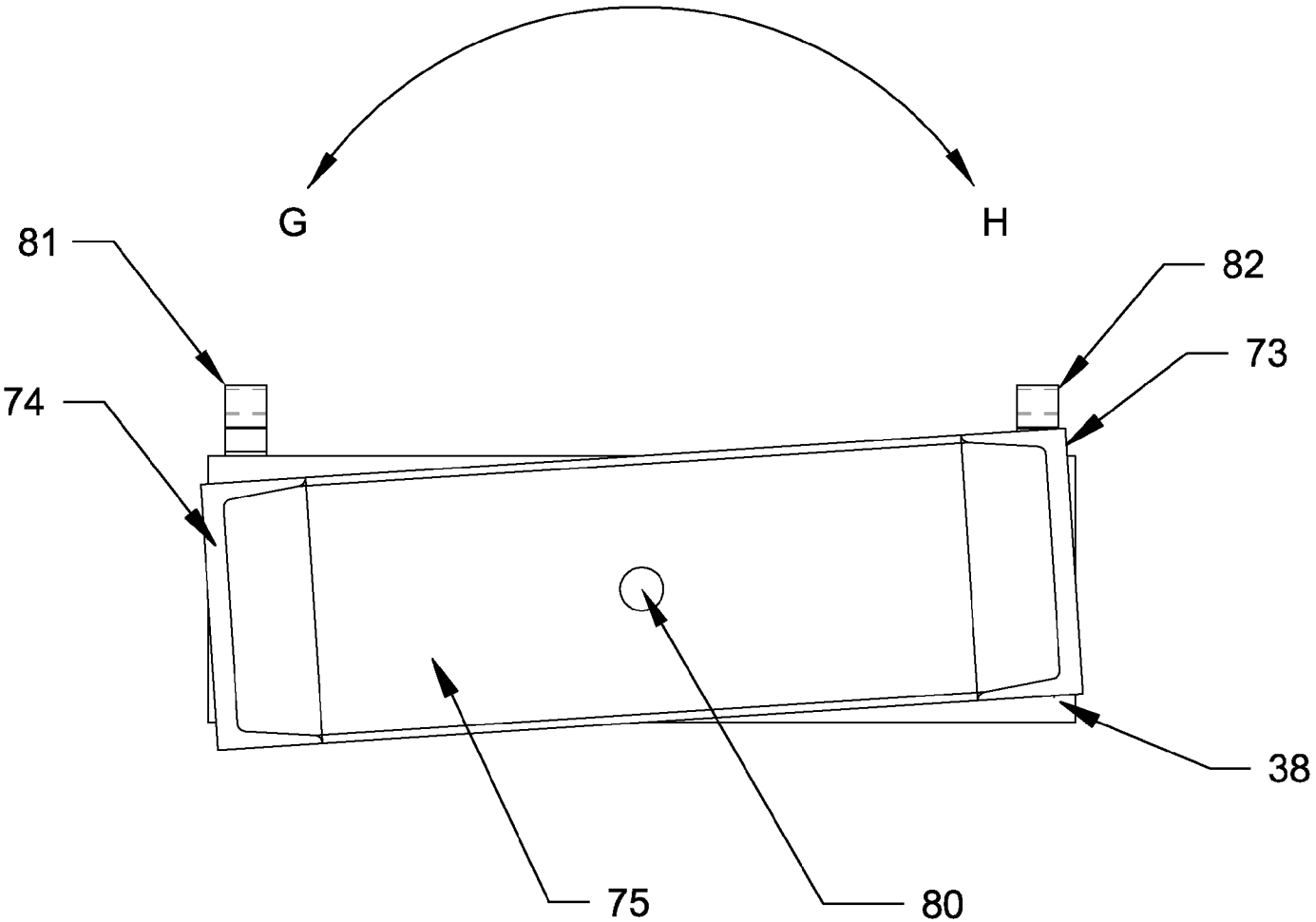
FIG. 17 is a cross-sectional planar end view of the pivot connection and stops where the frame mounting portion joins with the distribution and leveling portion showing the rotational movement G-H.
Figure 18:
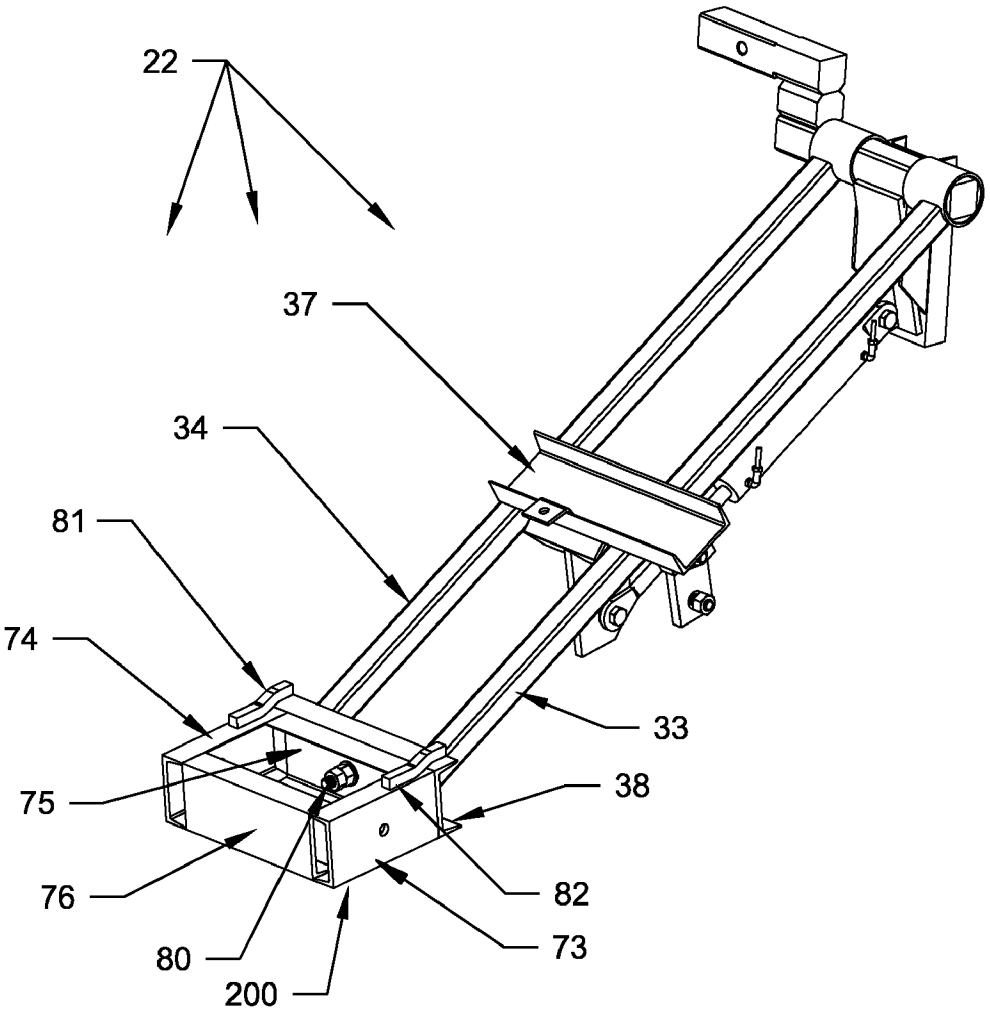
FIG. 18 is a perspective view of the pivot connection and stops where the frame mounting portion joins with the distribution and leveling portion of the present invention.

FIGS. 17 and 18 depict the pivotal connection 80 that joins the connection plate 38 of the frame mounting portion 22 to the inner frame structure 200. The frame support bars 33 and 34 are fixedly attached to the connection plate 38 as shown in FIGS. 4, 5 and 6. A pivot pin 80 passes through the connection plate 38 and through one side of the inner frame structure 200 located in the void created by the runners 50 and 51 and the vertical plates 53 and 54. This allows the inner structure 200, and thereby the entire distribution and leveling portion 23 to rotate in the direction "G-H" as shown in FIG. 12. There are two stops 81 and 82 fixed on either end of the inner frame structure 200 that limit the amount of "G-H" rotation that the inner frame structure 200, and consequently the distribution and leveling portion 23, can rotate.

Figure 23:
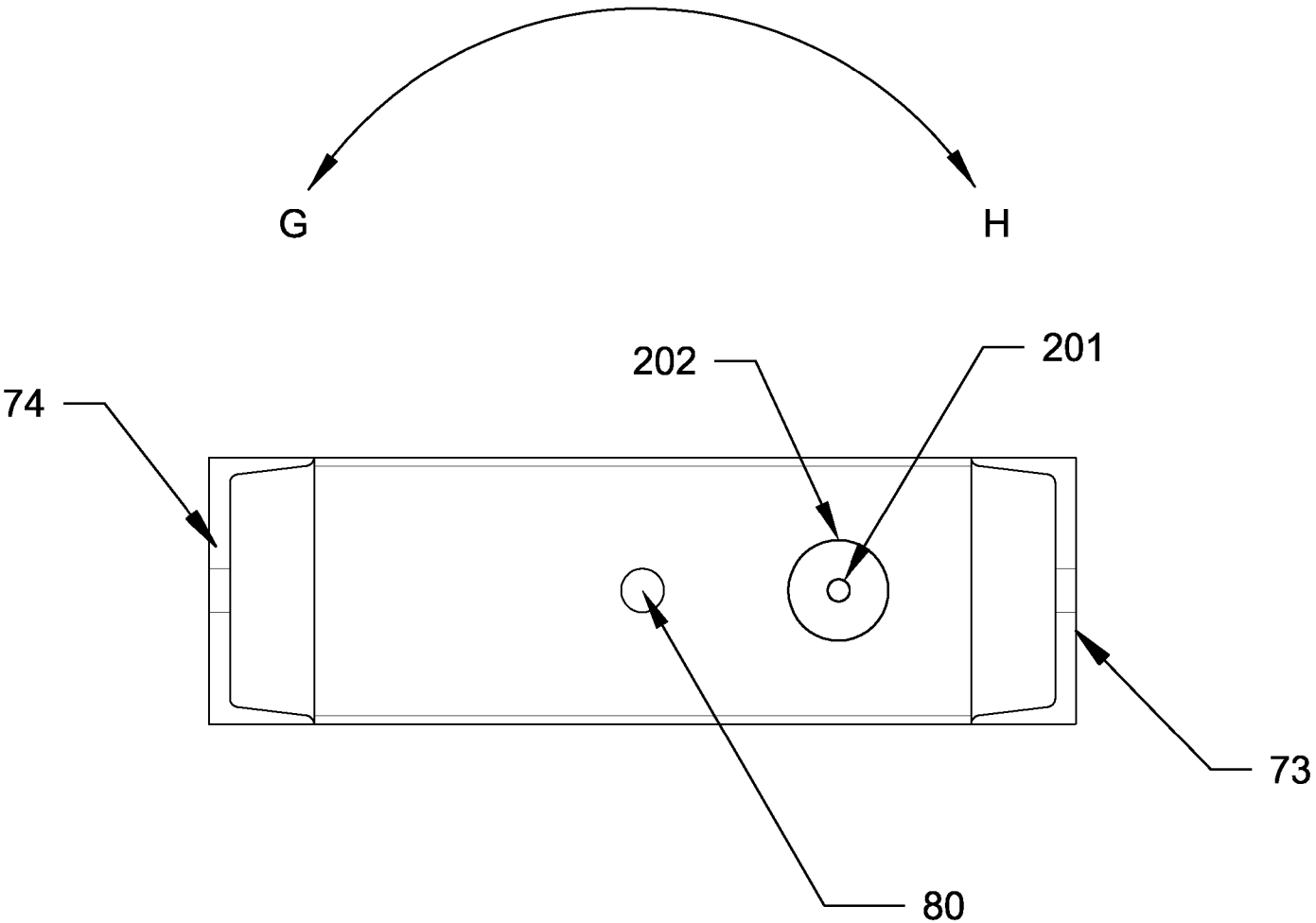
FIG. 23 is a cross-sectional end planar view depicting the rotational movement "G-H" with and alternate stop mechanism.

In an alternate embodiment, as shown in FIG. 23, the two stops 81 and 82 could be eliminated and replaced with a stop pin 201 fixed to the connection plate 38 and an enlarged hole 202 in one side of the inner frame structure 200. The stop pin 201 rides inside the enlarged hole 202 allowing the inner structure 200, and thereby the entire distribution and leveling portion 23 to rotate in the direction "G-H" as shown in FIG. 23 within the limits of the enlarged hole 202.

Figure 19:
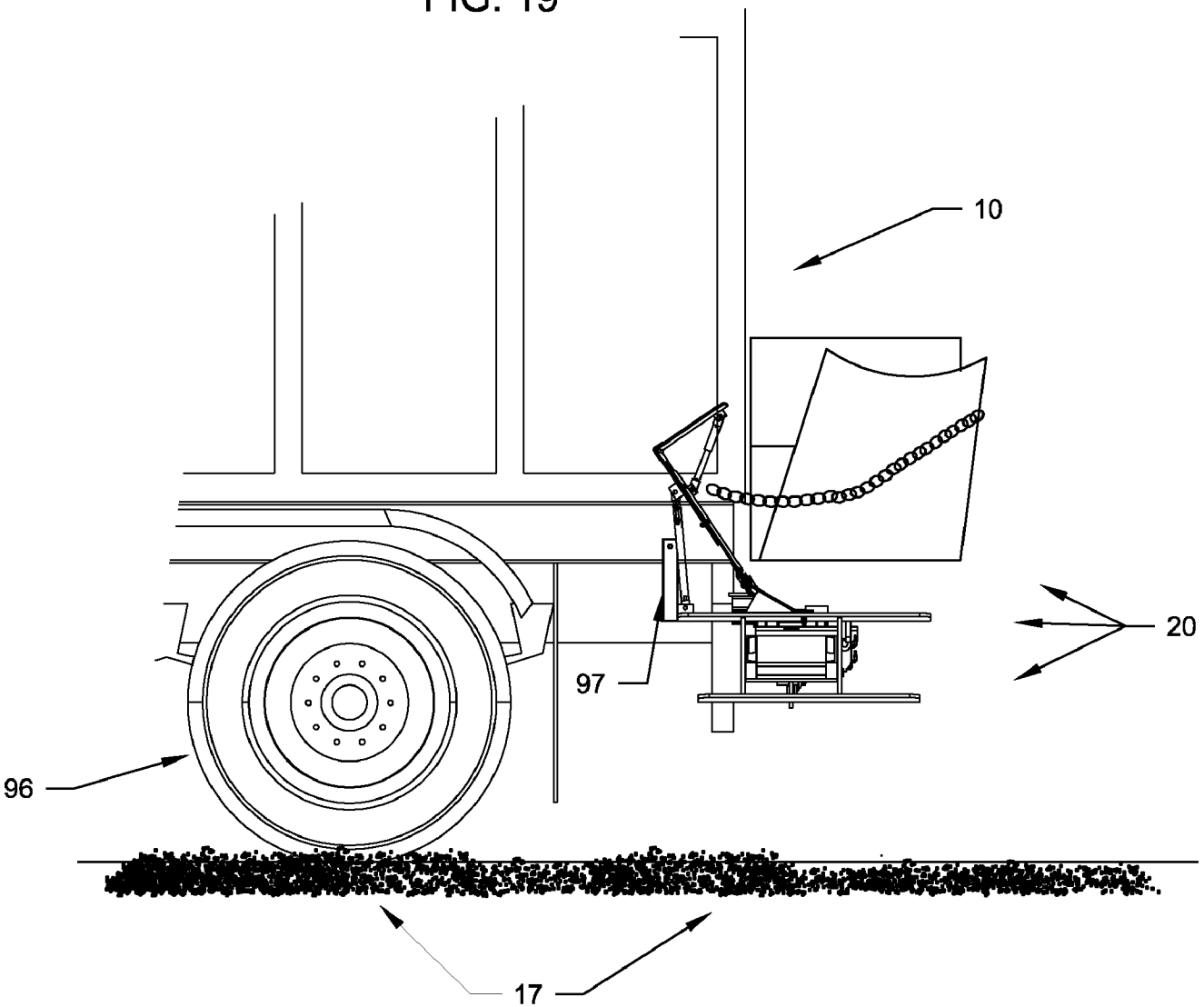
FIG. 19 is a side planar view of the present invention in its transportation position and showing the vehicle tires being used to compact the newly laid and leveled shoulder aggregate.

FIG. 19 depicts the distribution and leveling apparatus 20 secured in an upright position by a rod 97 for transportation. Also depicted are the rear tires 96 of the dump truck 10 driving over the leveled aggregate 17 and compacting the aggregate 17. FIG. 20 depicts a forward dumping dump truck 100 with the distribution and leveling apparatus 20 mounted in a forward moving direction attached behind the cab of the truck 100 with the mounting flange 32 depicted in FIG. 6.

Figure 22:
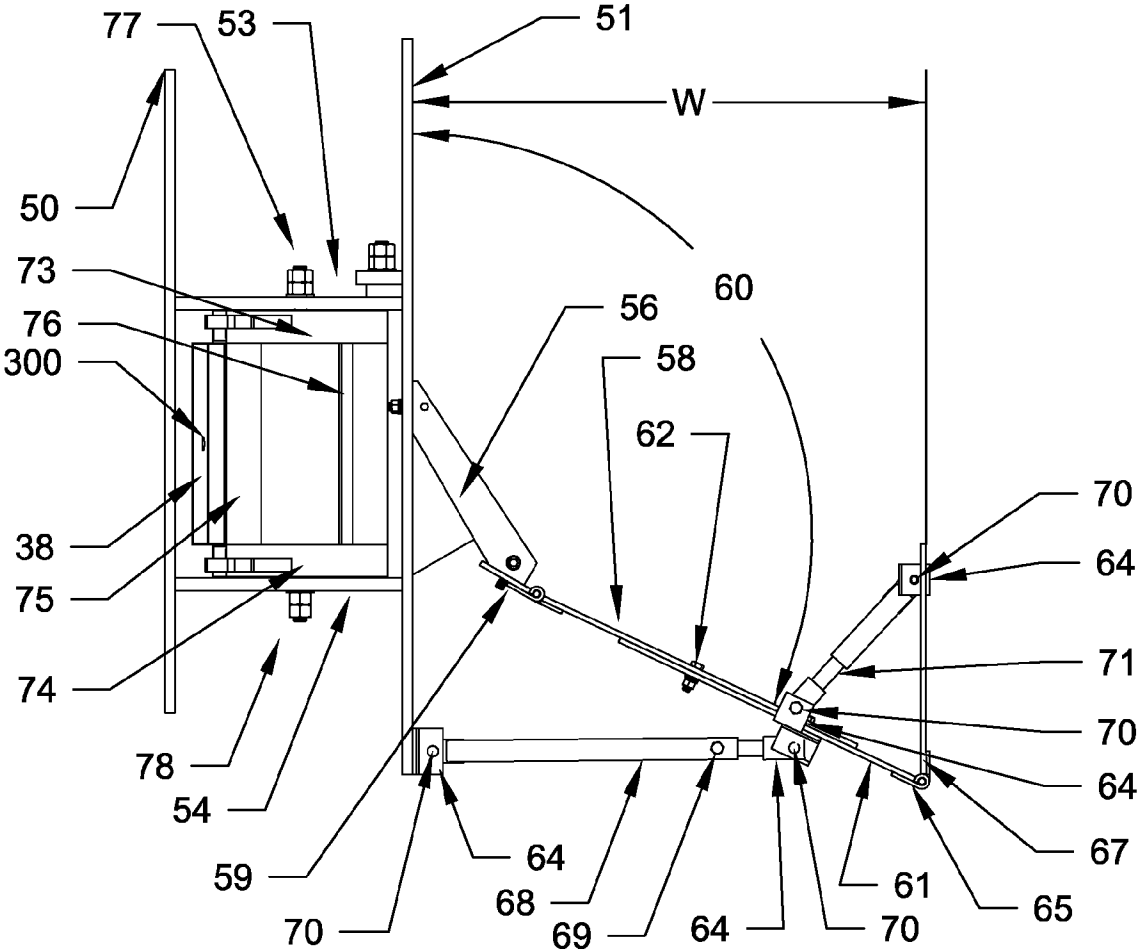
FIG. 22 is a top planar view of a second embodiment of the leveling portion mounted in a forward facing position.

To convert the apparatus 20 from a rearward operating position to a forward operating position, the support brace 56 shown in FIG. 21 is removed from the distribution and leveling portion 23 and reattached in the position shown in FIG. 22. The telescoping rods 68 and 71 are disconnected as is the inner and outer leveling blades 58 and 61 and reattached as depicted in FIG. 22.

The method for adjustably laying, leveling and compacting a shoulder in accordance with the present invention will now be explained. If necessary, an operator first removes any salt or sand spreading devices and any un-needed equipment such as a snow plow or the like. The operator then installs the distribution and leveling apparatus 20, either by attaching the hitch bar 30 to the truck's 10 or 100 receiver 25 or by attaching the mounting flange 32 to the truck frame 26 at a suitable location. The operator then connects the hydraulic hoses 90, 91, 46 and 47 to the truck's hydraulic systems and controls. Hydraulic systems, connections and controls are well know in the art and most dump trucks 10 or 100 come pre-equipped with such hydraulics, connections and controls. The hydraulic controls typically being located in the cab of the truck 10 or 100. The operator then activates the hydraulic controls for the first and second hydraulic cylinders 21 and 24 to raise the distribution and leveling device 20 off of the road surface 19 and into its upright position for transportation and secures the apparatus 20 with the rod 97. If the second hydraulic cylinder 24 is not available, the operator manually raises the distribution and leveling portion 23 and secures it to the side of the dump truck 10 with the rod 97.

The operator then drives the dump truck 10 or 100 to an aggregate filling yard and fills the dump truck bed with aggregate 17. The operator then drives the dump truck 10 or 100 to the road where shoulder application or maintenance is required. The operator then un-secures the rod 97 and the distribution and leveling apparatus 20 and, by means of the dump trucks hydraulics or manually, deploys the distribution and leveling apparatus 20 to the roadway 19. The operator then positions the distribution and leveling apparatus 20 such that the outer runner 51 is near the edge of the roadway 19. Based upon the current shoulder 18 conditions, the operator can then adjust the distribution and leveling portion 23 in a variety of means. First, the operator can infinitely adjust the angle 60 of the leveling blades 58 and 61, within the limits of the telescoping rod 68, to the outer runner 51 to allow for a deeper or shallower aggregate 17 fill amount next to the road by adjusting the first telescoping rod 68. Then the operator can infinitely adjust the angle 72 of the aggregate retention blade 67, within the limits of the second telescoping rod 71, so as to keep the loose aggregate 17 up on the shoulder by adjusting the second telescoping rod 71. Next, the operator can infinitely adjust the bottom of the leveling blades 58 and 61 up or down, within the limits of the length of the horizontal slots 97 in the support brace 56, to create a greater or lesser amount of loose and leveled aggregate 17 above the road surface 19 by loosening the fasteners 57 and turning the nut 103 attached to the height adjusting plate 92 which in turn raises or lowers the leveling blades 58 and 61 to a desired height D. Next the operator can infinitely adjust the pitch "P" of the shoulder 18, within the limits of the horizontal slot 94 in the first half of the distribution and leveling blade 58, by pivoting the leveling blades 58 and 61 about the lower fastener 57 and within the limits of the upper slotted hole 94 and then tightening the fasteners 57 to maintain the pitch "P" and height "D" adjustments. Next, the operator can infinitely adjust for the width "W" of the shoulder 18, within the limits of the slot 63 in the second half of the distribution and leveling blade 61, the setting of the angle 60 between the outer runner 51 and the first and second distribution and leveling blades 58 and 61, and the setting of the angle 72 between the retention blade 67 and the second half of the distribution and leveling blade 61, by loosening the fasteners 62 and sliding the outer leveling blade 61 by the fasteners 62 running in the slot 63 either in closer or further away from the outer runner 51 and then tightening the fasteners 62.

Once suitably adjusted, the operator returns to the cab of the dump truck 10 or 100 and raises the dump truck bed to get the aggregate 17 flowing toward the auger or conveyor belt 15 that the dump truck's 10 or 100 come equipped with. By activating the auger or conveyor belt 15 with the controls already existing in the dump truck, the aggregate 17 is moved to an opening where the aggregate 17 falls out and onto the material applicator or chute 16 which directs the aggregate 17 into the space between the outer runner 51, the inner and outer leveling blades 58 and 61 and the aggregate retention blade 67. Once a suitable amount of aggregate 17 has been deposited, the operator slowing backs the truck 10 or 100 down the road continuously laying the aggregate 17. Meanwhile, the distribution and leveling portion 23 evenly distributes and levels the aggregate 17 based upon the adjustments made as provided above.

The curved surfaces 52 of the runners 50 and 51 allow the distribution and leveling portion 23 to operate smoothly over the road surface 19. The pivot point 80 between the third channel 38 and the inner frame structure 200 at channel 75 allows the runners 50 and 51 to rotate vertically within the limits of the stops 81 and 82 to account for varying road heights. The inner frame structure 200 cooperating with the vertical plates 53 and 54 allow the distribution and leveling portion 23 to rotate thereby allowing variation in the road surface linear irregularities running crosswise to the roads 19 direction. The rotation of the frame mounting portion 22 about the hitch bar 30 accommodates the rotational or yaw movement of the roadway 19 in relation to the truck frame 26. In an alternative embodiment, the distribution and leveling portion 23 could rotate within the limits created by the hole 202 and the pin 201 shown in FIG. 23.

Once the aggregate is laid and leveled, the operator returns the distribution and leveling apparatus 20 to its upright position for transportation and secures the apparatus 20 with the rod 97 or other securing means well known in the art. The operator then directs the dump truck 10 or 100 onto the loose and leveled aggregate 17 and slowly drives over the aggregate using the truck tires 96 to compact the shoulder aggregate 17.

In an alternative embodiment of the present invention, the apparatus 20 can be mounted on the right hand side, or passenger side, of the truck 10 or 100 in a forward leveling position. The operator then follows the procedures above for filing the dump truck 10 or 100 and setting the pitch, width, height and other adjustments described above. The operator then drives the truck 10 or 100 forward while depositing and leveling the aggregate 17 on the shoulder. Once the aggregate 17 is deposited and leveled, the operator backs the truck 10 or 100 up and slowly drives over the aggregate 17 with the truck's tires being utilized to compact the aggregate 17.

In an identical manner, asphalt could be laid, leveled and compacted to various widths, pitch and yaw or utilized to patch small areas or holes in the roadway 19. In a further embodiment, the runners 50 and 51 could have hardened edges or a carbide or other suitable material attached to the base of the runners 50 and 51 to reduce the wear on the runners 50 and 51 similar to snow plow blades.

For those areas with dump trucks 10 and 100, but without hydraulics, such as in the southern States where there is no need for salting and snow plowing, electrical servo-motors can be substituted for the hydraulics to accomplish the same movements provided by the hydraulic cylinders 21 and 24.

In compliance with the statute, the invention and method of operation has been described in language more or less specific as to the structural features. It is to understood, however, that the invention is not limited to the specific features shown, since the means and construction herein disclosed comprise a preferred form of putting the invention into practice. The invention is, therefore, claimed in any of its forms or modifications within the proper scope of the appended claims, appropriately interpreted in accordance with the doctrine of equivalents.

I claim:

1. An adjustable attachment for dump trucks having front and rear wheels, a roadway bulk material receiving dump bed, an aggregate feeding mechanism, a chute leading downwardly from the dump bed for discharging roadway aggregate and hydraulic systems and controls, said adjustable attachment comprising:

a hitch bar;

a first vertical support bar fixed to said hitch bar;

a frame mounting portion rotatably connected to said hitch bar by hollow cylinders, said frame mounting portion comprising frame support bars, a second support, a first hydraulic cylinder rotatably connected at a first end to said first vertical support bar and at a second end to said second support bar, said hydraulic cylinder being operably connected to said dump truck hydraulic systems for raising and lowering said frame mounting portion of said apparatus and a connection plate;

a distribution and leveling portion comprising inner and outer runners, two vertical plates, an inner frame structure pivotably attached to said two vertical plates and pivotably attached to said connection plate on said frame portion, a support bracket attached at a first end to said outer runner by fasteners and at a second end by fasteners to a first half of a distribution and leveling blade, said first half of said distribution and leveling blade being rotatable about a hinge proximate said support bracket, a second half of a distribution and leveling blade being slidably connected to said first half of said distribution and leveling blade by horizontal slots and fasteners, and adjustable telescoping rod, temporarily held in place with a set screw, connected at a first end to said outer runner and at a second end to said second half of said distribution and leveling blade, an aggregate retention blade hingedly attached to said second half of said distribution and leveling blade, a second telescoping rod pivotably, temporarily held in place by a set screw, connected at a first end to said aggregate retention blade at a second end to said second half of said distribution and leveling blade;

said adjustable apparatus being adjustable as to the width of applied roadway aggregate by releasing fasteners coupling said first and said second distribution and leveling blades, releasing said telescoping rods set screws, sliding said second half of said distribution and leveling blade in towards said outer runner to reduce the width of said applied roadway aggregate or sliding said second half of said distribution and leveling blade out away from said outer runner to increase the width of said applied roadway aggregate and tightening said telescoping rod set screws and said fasteners coupling said first and said second distribution and leveling blades.

2. The adjustable attachment as claimed in claim 1 wherein said width of said applied roadway aggregate material can be further adjusted narrower or wider by releasing the telescoping rod set screws, pivoting said first and second distribution and leveling blades about said hinge proximate said support bracket and tightening said telescoping rod set screws.

3. The adjustable attachment as claimed in claim 1 or claim 2 wherein said width of said applied roadway aggregate material can be further adjusted narrower or wider by releasing said set screw of said second adjustable rod and pivoting said aggregate retention blade about said hinge and tightening said second telescoping rod set screw.

4. The adjustable attachment as claimed in claim 1 or claim 2 wherein the pitch of said first and second said distribution and leveling blades can be adjusted by loosening said fasteners attaching said first half of said distribution and leveling blade to said support bracket and pivoting said first and second half of said distribution and leveling blades about a lower hole in said first half of said distribution and leveling blade within the limits of the horizontally slotted hole in said first half of said distribution and leveling blade and retightening said fasteners attaching said first half of said distribution and leveling blade to said support bracket.

5. The adjustable attachment as claimed in claim 1 or claim 2 wherein the depth of said aggregate being laid and leveled above the said roadway can be adjusted by loosening the fasteners going through the height adjustment plate, the support bracket and said first half of said distribution and leveling blade, turning the nut on the threaded rod attached to said height adjustment plate, said nut resting on the adjustment bar, which raises or lowers the height adjustment plate and said first and second halves of said distribution and leveling blade within the limits of the vertical slots in said support bracket.

6. The adjustable attachment as claimed in claim 1 or claim 2 above wherein said hydraulic cylinder is replaced with an electrical servo-motor, said servo-motor being operably connected to said dump truck by electrical wires.

7. The adjustable attachment as claimed in claim 1 or claim 2 above wherein said first and second halves of said apparatus is raised and secured in an upright position for transportation.

8. An adjustable attachment for dump trucks having front and rear wheels, a roadway bulk material receiving dump bed, an aggregate feeding mechanism, a chute leading downwardly from the dump bed for discharging roadway aggregate and hydraulic systems and controls, said adjustable attachment comprising:

a hitch bar;

a first vertical support bar fixed to said hitch bar;

a frame mounting portion rotatably connected to said hitch bar by hollow cylinders, said frame mounting portion comprising frame support bars, a second support, a first hydraulic cylinder rotatably connected at a first end to said first vertical support bar and at a second end to said second support bar, said hydraulic cylinder being operably connected to said dump truck hydraulic systems for raising and lowering said frame mounting portion of said apparatus and a connection plate;

a distribution and leveling portion comprising inner and outer runners, two vertical plates, an inner frame structure pivotably attached to said two vertical plates and pivotably attached to said connection plate on said frame portion, a support bracket attached at a first end to said outer runner by fasteners and at a second end by fasteners to a first half of a distribution and leveling blade, said first half of said distribution and leveling blade being rotatable about a hinge proximate said support bracket, a second half of a distribution and leveling blade being slidably connected to said first half of said distribution and leveling blade by horizontal slots and fasteners, and adjustable telescoping rod, temporarily held in place with a set screw, connected at a first end to said outer runner and at a second end to said second half of said distribution and leveling blade, an aggregate retention blade hingedly attached to said second half of said distribution and leveling blade, a second telescoping rod pivotably, temporarily held in place by a set screw, connected at a first end to said aggregate retention blade at a second end to said second half of said distribution and leveling blade, a second hydraulic cylinder pivotably connected at a first end said second support bracket and at a second end pivotably connected to said vertical plate, said second hydraulic cylinder being operably connected to said dump truck hydraulic systems for raising and lowering said distribution and leveling portion of said apparatus;

said adjustable apparatus being adjustable as to the width of applied roadway aggregate by releasing fasteners coupling said first and said second distribution and leveling blades, releasing said telescoping rods set screws, sliding said second half of said distribution and leveling blade in towards said outer runner to reduce the width of said applied roadway aggregate or sliding said second half of said distribution and leveling blade out away from said outer runner to increase the width of said applied roadway aggregate and tightening said telescoping rod set screws and said fasteners coupling said first and said second distribution and leveling blades.

9. The adjustable attachment as claimed in claim 8 wherein said width of said applied roadway aggregate material can be further adjusted narrower or wider by releasing the telescoping rod set screws, pivoting said first and second distribution and leveling blades about said hinge proximate said support bracket and tightening said telescoping rod set screws.

10. The adjustable attachment as claimed in claim 8 or claim 9 wherein said width of said applied roadway aggregate material can be further adjusted narrower or wider by releasing said set screw of said second adjustable rod and pivoting said aggregate retention blade about said hinge and tightening said second telescoping rod set screw.

11. The adjustable attachment as claimed in claim 8 or claim 9 wherein the pitch of said first and second said distribution and leveling blades can be adjusted by loosening said fasteners attaching said first half of said distribution and leveling blade to said support bracket and pivoting said first and second half of said distribution and leveling blades about a lower hole in said first half of said distribution and leveling blade within the limits of the horizontally slotted hole in said first half of said distribution and leveling blade and retightening said fasteners attaching said first half of said distribution and leveling blade to said support bracket.

12. The adjustable attachment as claimed in claim 8 or claim 9 wherein the depth of said aggregate being laid and leveled above the said roadway can be adjusted by loosening the fasteners going through the height adjustment plate, the support bracket and said first half of said distribution and leveling blade, turning the nut on the threaded rod attached to said height adjustment plate, said nut resting on the adjustment bar, which raises or lowers the height adjustment plate and said first and second halves of said distribution and leveling blade within the limits of the vertical slots in said support bracket.

13. The adjustable attachment as claimed in claim 8 or claim 9 above wherein said first and second hydraulic cylinders are replaced with electrical servo-motors, said servo-motors being operably connected to said dump truck by electrical wires.

14. The adjustable attachment as claimed in claim 8 or claim 9 above wherein said first and second halves of said apparatus is raised and secured in an upright position for transportation.

15. An adjustable attachment for dump trucks having front and rear wheels, a roadway bulk material receiving dump bed, an aggregate feeding mechanism, a chute leading downwardly from the dump bed for discharging roadway aggregate and hydraulic systems and controls, said adjustable attachment comprising:

a hitch bar;

a first vertical support bar fixed to said hitch bar;

a frame mounting portion rotatably connected to said hitch bar by hollow cylinders, said frame mounting portion comprising frame support bars, a second support, a first hydraulic cylinder rotatably connected at a first end to said first vertical support bar and at a second end to said second support bar, said hydraulic cylinder being operably connected to said dump truck hydraulic systems for raising and lowering said frame mounting portion of said apparatus and a connection plate;

a distribution and leveling portion comprising inner and outer runners, two vertical plates, an inner frame structure pivotably attached to said two vertical plates and pivotably attached to said connection plate on said frame portion, a support bracket attached at a first end to said outer runner by fasteners and at a second end by fasteners to a first half of a distribution and leveling blade, said first half of said distribution and leveling blade being rotatable about a hinge proximate said support bracket, a second half of a distribution and leveling blade being slidably connected to said first half of said distribution and leveling blade by horizontal slots and fasteners, and adjustable telescoping rod, temporarily held in place with a set screw, connected at a first end to said outer runner and at a second end to said second half of said distribution and leveling blade, an aggregate retention blade hingedly attached to said second half of said distribution and leveling blade, a second telescoping rod pivotably, temporarily held in place by a set screw, connected at a first end to said aggregate retention blade at a second end to said second half of said distribution and leveling blade, a second hydraulic cylinder pivotably connected at a first end said second support bracket and at a second end pivotably connected to said vertical plate, said second hydraulic cylinder being operably connected to said dump truck hydraulic systems for raising and lowering said distribution and leveling portion of said apparatus;

said adjustable apparatus being adjustable as to the width of applied roadway aggregate by releasing fasteners coupling said first and said second distribution and leveling blades, releasing said telescoping rods set screws, sliding said second half of said distribution and leveling blade in towards said outer runner to reduce the width of said applied roadway aggregate or sliding said second half of said distribution and leveling blade out away from said outer runner to increase the width of said applied roadway aggregate and tightening said telescoping rod set screws and said fasteners coupling said first and said second distribution and leveling blades;

said adjustable apparatus being further adjustable for narrower or wider applied roadway aggregate by releasing the telescoping rod set screws, pivoting said first and second distribution and leveling blades about said hinge proximate said support bracket and tightening said telescoping rod set screws;

said adjustable apparatus being further adjustable as to width of applied roadway aggregate, narrower or wider, by releasing said set screw of said second adjustable rod and pivoting said aggregate retention blade about said hinge and tightening said second telescoping rod set screw;

the pitch of said first and second said distribution and leveling blades being adjustable by loosening said fasteners attaching said first half of said distribution and leveling blade to said support bracket and pivoting said first and second half of said distribution and leveling blades about a lower hole in said first half of said distribution and leveling blade within the limits of the horizontally slotted hole in said first half of said distribution and leveling blade and retightening said fasteners attaching said first half of said distribution and leveling blade to said support bracket; and the depth of said aggregate being laid and leveled above the said roadway being adjustable by loosening the fasteners going through the height adjustment plate, the support bracket and said first half of said distribution and leveling blade, turning the nut on the threaded rod attached to said height adjustment plate, said nut resting on the adjustment bar, which raises or lowers the height adjustment plate and said first and second halves of said distribution and leveling blade within the limits of the vertical slots in said support bracket.

16. The adjustable attachment as claimed in claim 15 above wherein said first and second hydraulic cylinders are replaced with electrical servo-motors, said servo-motors being operably connected to said dump truck by electrical wires.

17. The adjustable attachment as claimed in claim 15 above wherein said first and second halves of said apparatus is raised and secured in an upright position for transportation.

* * * * *